US009840356B1

(12) United States Patent
Spruce

(10) Patent No.: US 9,840,356 B1
(45) Date of Patent: Dec. 12, 2017

(54) CLOSURE WITH FORCE AMPLIFYING LEVER

(71) Applicant: Ariadne Design LLC, St. Paul, MN (US)

(72) Inventor: Ian James Spruce, Horton (GB)

(73) Assignee: Ariadne Design LLC, St. Paul, MN (US)

( * ) Notice: Subject to any disclaimer, the term of this patent is extended or adjusted under 35 U.S.C. 154(b) by 0 days.

(21) Appl. No.: 15/352,361

(22) Filed: Nov. 15, 2016

(51) Int. Cl.

| | |
|---|---|
| ***B65D 41/56*** | (2006.01) |
| ***B65D 51/00*** | (2006.01) |
| ***B65D 25/28*** | (2006.01) |
| ***B65D 43/26*** | (2006.01) |
| ***B65D 41/50*** | (2006.01) |
| ***B65D 43/02*** | (2006.01) |
| ***B65B 43/38*** | (2006.01) |
| ***B65B 43/40*** | (2006.01) |
| ***B65D 41/00*** | (2006.01) |
| ***B65D 43/00*** | (2006.01) |

(52) U.S. Cl.
CPC ..... *B65D 43/267* (2013.01); *B65D 41/50* (2013.01); *B65D 43/0225* (2013.01)

(58) Field of Classification Search
CPC .. B65D 43/267; B65D 43/0225; B65D 41/50; B65D 43/26; B65D 43/265; B65D 2543/00879; B65D 2543/00888; B65D 2543/0861
USPC ..... 220/212.5; 215/295
See application file for complete search history.

(56) References Cited

U.S. PATENT DOCUMENTS

| | | | |
|---|---|---|---|
| 1,761,597 | A | 6/1930 | Taylor |
| D87,644 | S | 8/1932 | Rettich |
| 1,978,272 | A | 10/1934 | Lawrence |

(Continued)

FOREIGN PATENT DOCUMENTS

| | | | |
|---|---|---|---|
| CN | 102616440 | A | 4/2012 |
| DE | 202006010719 | U1 | 10/2006 |

(Continued)

OTHER PUBLICATIONS

"Adjustable Lever Ring for PIG® Latching Drum Lid Draining Funnel", printed from www.newpig.com/adjustable-lever-ring-for-pig-latching-drum-lid-draining-funnel/p/DRM1049, publicly available at least as early as Jul. 26, 2016 (3 pages).

(Continued)

*Primary Examiner* — Andrew T Kirsch
(74) *Attorney, Agent, or Firm* — JoAnn M. Seaton; Griffiths & Seaton PLLC

(57) ABSTRACT

A closure, for rotatably coupling with a container to cover an opening of the container, includes a lid and a lever. The lid includes a primary panel defining a top surface, a skirt configured to couple with the container, and a stop positioned adjacent the top surface of the primary panel. The lid defines an outermost perimeter, and a footprint of the lid is defined within the outermost perimeter. The lever is rotably coupled with the lid to rotate relative to the lid between a use position and a storage position. When the lever is in the storage position, the lever is maintained substantially within the footprint of the lid. When the lever is in the use position, the lever extends outwardly beyond the outermost perimeter of the lid contacting the stop of the lid such that force applied to lever is transferred to the lid via the stop.

19 Claims, 15 Drawing Sheets

(56) References Cited

U.S. PATENT DOCUMENTS

| | | | | |
|---|---|---|---|---|
| 2,447,146 | A | 8/1948 | Vogel | |
| 3,625,386 | A | 12/1971 | Schaefer | |
| 3,866,782 | A | 2/1975 | Westfall | |
| 4,043,479 | A * | 8/1977 | Khoury | B65D 17/163 220/271 |
| 5,358,129 | A | 10/1994 | Watts | |
| 5,411,157 | A | 5/1995 | King et al. | |
| 5,429,257 | A | 7/1995 | Greenfield et al. | |
| 5,437,382 | A | 8/1995 | Gluckman | |
| 5,579,932 | A | 12/1996 | Drozd et al. | |
| 5,590,799 | A | 1/1997 | King | |
| 5,704,502 | A | 1/1998 | Greenfield | |
| 5,941,404 | A | 8/1999 | Charrette | |
| 6,029,834 | A | 2/2000 | Sanner | |
| 6,029,835 | A | 2/2000 | DeJonge | |
| 6,202,869 | B1 | 3/2001 | Sullivan | |
| 6,253,942 | B1 | 7/2001 | Elias | |
| D467,803 | S | 12/2002 | Brown et al. | |
| 6,530,500 | B2 | 3/2003 | Bravo et al. | |
| 6,547,102 | B2 * | 4/2003 | Stoneberg | B65D 21/0219 222/143 |
| 6,634,525 | B2 | 10/2003 | Bravo et al. | |
| 6,729,491 | B2 * | 5/2004 | Morris, Jr. | B65D 21/0219 220/212.5 |
| 7,028,359 | B2 | 4/2006 | Mazur | |
| 7,523,525 | B2 * | 4/2009 | Lawless | B25B 33/00 16/430 |
| D613,161 | S | 4/2010 | Greenfield | |
| D621,706 | S | 8/2010 | Breckan | |
| 8,668,098 | B2 | 3/2014 | Wand | |
| D708,520 | S | 7/2014 | Schick | |
| 9,346,590 | B2 | 5/2016 | Ramsey | |
| 2004/0200797 | A1 | 10/2004 | Hicks et al. | |
| 2004/0237724 | A1 | 12/2004 | Cope | |
| 2006/0000835 | A1 | 1/2006 | Wikstrom et al. | |
| 2007/0045219 | A1 | 3/2007 | Nasiatka | |
| 2011/0139745 | A1 | 6/2011 | Ezra et al. | |

FOREIGN PATENT DOCUMENTS

| | | | |
|---|---|---|---|
| EP | 0679582 | A1 | 2/1995 |
| EP | 1405820 | A1 | 4/2004 |
| GB | 7666165 | A | 1/1957 |
| WO | 2014184341 | A1 | 11/2014 |
| WO | 2016096557 | A1 | 6/2016 |

OTHER PUBLICATIONS

"Multi-Function Bottle/Can/Jar Opener 7 in 1 Kitchen Tool Cooking Tools Can Opener", printed from www.aliexpress.com/store/product/Multi-Function-Bottle-Can-J...6-in-1-Kitchen-Tool-cooking-tools-Can-Opener/233183_1735210680.html, publicly available at least as early as Jul. 22, 2016 (3 pages).

"Lever Drum Ring", printed from https://www.newpig.com/lever-drum-ring/p/DRM534?searchTerm=lever+drum+ring, publicly available at least as early as Aug. 30, 2012 (5 pages).

"Printed Medicine Bottle Opener", printed from www.usimprints.com/product/medicine-bottle-opener-8154...ct% 2Bsearch&utm_campaign=base&gclid=CPSAwfLjh84CFQMMaQodv5wMQg, publicly available at least as early as Jul. 22, 2016 (3 pages).

"Good Grips Jar Opener by OXO", printed from www.arthritissupplies.com/good-grips-jar-opener.html, publicly available at least as early as Mar. 13, 2012, per http://web.archive.org (4 pages).

"Jokari Ring Pull Can Opener with Non-Slip Grip", printed from www.amazon.com/Jokari-Ring-Pull-Opener-Non-Slip/dp/B002LF6WS6?ie=UTF8&tag=americaninven-20, publicly available at least as early as Oct. 2, 2001 (7 pages).

"Cando™", printed from www.daka.com.hk/product_detail/index/54, publicly available at least as early as May 16, 2015, per http://web.archive.org (3 pages).

"Multi Grip—Twist Cap Opener", printed from www.amazon.com/Multi-Grip-Twist-Cap-Opener/dp/B000GFOIWU, publicly available at least as early as Oct. 2, 2001 (7 pages).

"Arthritic Aids Bottle Openers", printed from www.imprintitems.com/arthritis2.htm, publicly available at least as early as Feb. 28, 2004, per http://web.archive.org (7 pages).

* cited by examiner

CLOSURE WITH FORCE AMPLIFYING LEVER

BACKGROUND OF THE INVENTION

Screw top or other closures, such as lids, caps, covers, etc., rotatably couple with corresponding bottles, jars, and other containers providing means for securely covering the containers while still generally allowing the containers to be opened by a typical user without the need for a bottle opener, can opener, or other tool. For at least these reasons, screw-top closures have wide spread use in many product areas, such as health and beauty, household, automotive, pharmaceutical, food and nutrition, toys, pet care, office supplies, baby care, and many others. However, since often such containers are very tightly sealed at factories and/or are tightly resealed after use, a user may have trouble unscrewing the lid from the container. This issue is amplified when the overall diameter of the lid is particularly small or particularly large, such that it is difficult for the user to get a good handgrip on the lid. Troubles in opening rotatably covered containers is additionally increased when the user is weak, such as when the user is a child, is elderly, or is otherwise weakened by a medical condition.

SUMMARY

One embodiment of the present invention relates to a closure for rotatably coupling with a container to cover an opening of the container. The closure includes a lid and a lever. The lid includes a primary panel defining a top surface, a skirt extending away from the primary panel and being configured to couple with the container, and a stop positioned adjacent the top surface of the primary panel. The lid defines an outermost perimeter. A footprint of the lid is defined within the outermost perimeter of the lid. The lever is rotably coupled with the lid such that the lever rotates relative to the lid between a use position and a storage position. When the lever is in the storage position, the lever is maintained substantially within the footprint of the lid. When the lever is in the use position, the lever extends outwardly beyond the outermost perimeter of the lid contacting the stop of the lid such that force applied to lever is transferred to the lid via the stop. Other levers, lids, closures, and container assemblies are also described herein.

BRIEF DESCRIPTION OF THE DRAWINGS

Embodiments of the invention will be described with respect to the figures, in which like reference numerals denote like elements, and in which.

DETAILED DESCRIPTION

Figure 1:
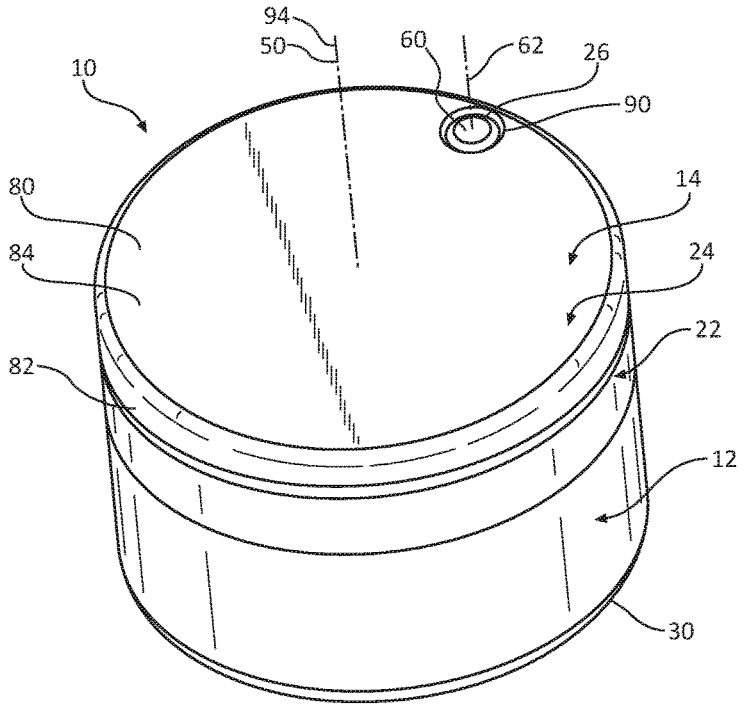
FIG. 1 is a front perspective view illustration of a container assembly including a closure having a lever in a storage position, according to one embodiment of the present invention.

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship, orientation, or order. In addition, as used herein, the term "about" or "substantially" apply to all numeric values or descriptive terms, respectively, and generally indicate a range of numbers or characteristics that one of skill in the art would consider equivalent to the recited values or terms, that is, having the same function or results.

This innovation provides a closure including a lid, configured to be rotably coupled around a container opening, and a lever rotably coupled with the lid. In one embodiment, the lid independently covers the container opening, and the lever is configured to be rotated relative to the lid between a storage position to a use position. In the storage position, the lever fits a top the lid, generally maintained within an overall footprint of the lid. When the lever is rotated to the use position, the lever extends beyond an outermost perimeter of the lid of the closure. Force applied to outer portions of the lever, while the lever is in the use position, are transferred to the lid to open or tightly close the lid. Since the lever is positioned further away from a rotational axis of the lid than an edge of the lid itself, the lever increases the distance between a center axis of the lid and the opening force applied to the closure. In this manner, since torque is the product of the amount of force applied and the distance that force is spaced away from a rotational axis of an object, the torque applied to the lid via force from the lever is increased or amplified, as compared to torque applied to the lid via an equal force applied directly to the lever. Consequently, using the lever, a smaller force is able to generate a greater lid opening torque allowing the lid to be removed from a corresponding container more easily, that is, with less applied force.

Since the lever is permanently coupled with the lid, in one embodiment, the lever is integrated with the closure. This integration allows users to immediately access and use lever to open the container, without a need to hunt for and find a separate opening tool thereto. The integration of the lever to the lid is particularly helpful for those suffering from dementia or other memory problems, who could be set off their original course to open a container by a search for an opening tool in a manner that may result in the user unintentionally abandoning that initial course altogether. Where a container is used to store a food product, the opening tool search may be detrimental to the overall nutrition of the user, which is already a common concern for dementia patients. As such, since a closure having an integrated lever to assist in opening a container eliminates the need to search for a separate opening tool, the closure described herein is greatly beneficial to memory deficient users. Various embodiments of lid and lever closure configurations are disclosed herein as example embodiments. Other embodiments incorporating the teachings of this innovation are also contemplated and will be apparent to those of skill in the art upon reading this application.

Turning to the Figures, FIG. 1 is a perspective view illustration of a container assembly 10 including a container 12 and a closure 14, according to one embodiment of the invention. In general, closure 14 includes a lid 22 covering, or being configured to cover, and rotatably coupled to container 12. Closure 14 further includes a lever 24 coupled to a top of lid 22, for example, about a coupling pin 26. Lever 24 is rotatable about coupling pin 26 between a storage position and a use position. In the storage position, lever 24 is maintained within an overall footprint of lid 22, such that lever 24 does not change the amount of shelf space needed to store container assembly 10. When rotated about coupling pin 26 to the storage position, lever 24 extends at least partially outside the overall footprint of lid 22. Lid 22 includes at least one stop 28 configured to interact with lever 24 to stop rotational movement of lever 24 about coupling pin 26, such that force applied to lever 24 is transferred to lid 22, thereby rotating lid 22 relative to container 12 and eventually removing lid 22 from container 12.

More specifically, one example of container 12 is illustrated with reference to FIGS. 1 and 2, but it should be understood than many differently sized and shaped containers, such as jars, bottles, etc. formed of various materials such as plastic and/or glass are contemplated and acceptable for use with this current innovation. Container 12 includes a bottom panel 30 (generally indicated in FIGS. 1 and 2) and a sidewall 32 extending upwardly from and surrounding bottom panel 30 to define a storage chamber 36 having a open top 34. Container 12 is configured to receive closure 14 within or about open top 34 in a rotatably securable and rotatably un-securable manner, as will be apparent to those of skill in the art upon reading this application. In one embodiment, as best illustrated in FIG. 2, container 12 includes threads 38 on an internal surface or external surface thereof, as illustrated, just below open top 34 for interacting with closure 14.

Figure 2:
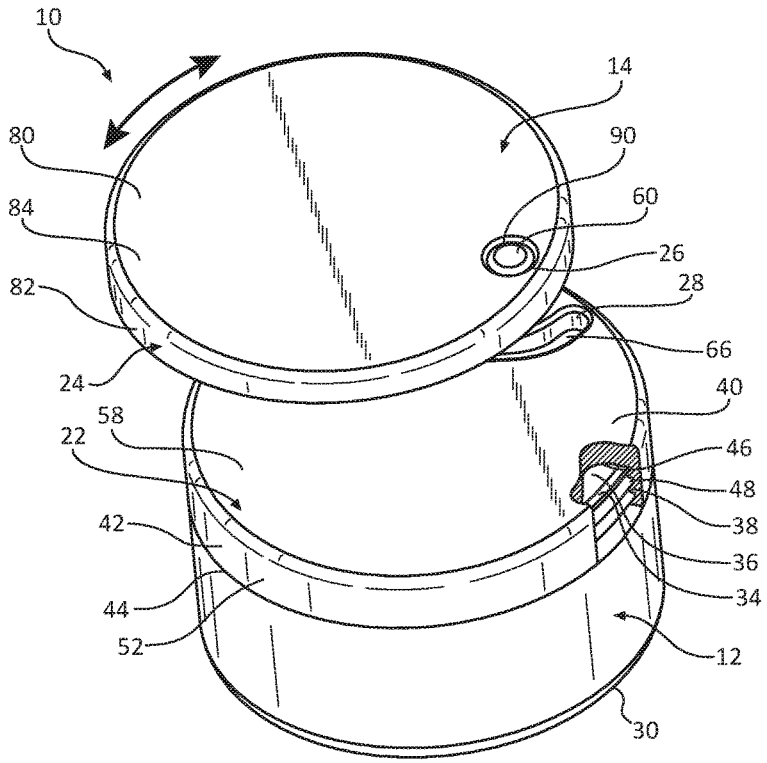
FIG. 2 is a front perspective view illustration of the container assembly of FIG. 1 where the lever is in a use position, according to one embodiment of the present invention.
Figure 3:
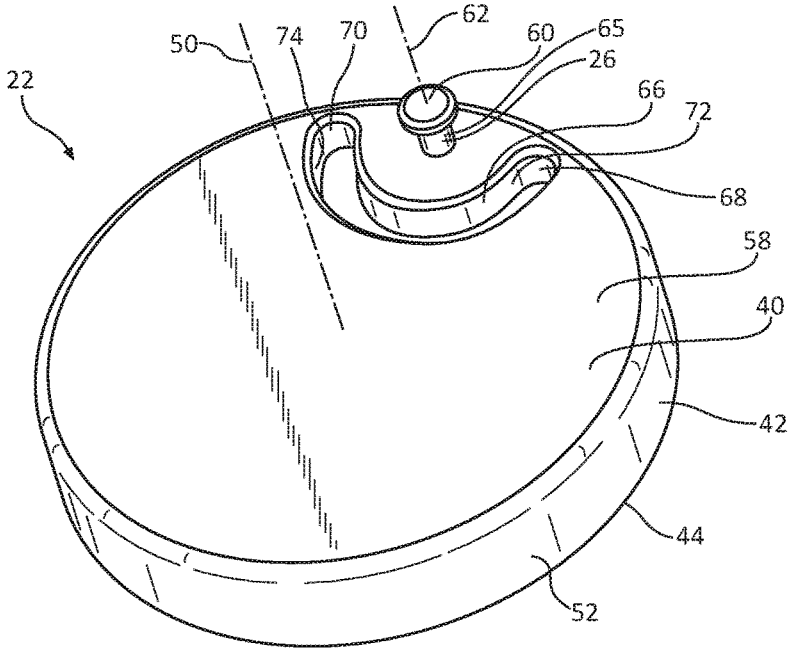
FIG. 3 is a front perspective view illustration of a lid of the closure of FIG. 1, according to one embodiment of the present invention.

One example of closure 14 including lid 22 and lever 24 is also illustrated in FIGS. 1 and 2. Additionally referring to the isolated view of lid 22 in FIG. 3, in one embodiment, lid 22 includes a primary panel 40 and depending skirt 42 extending downwardly from primary panel 40, substantially adjacent to an outer perimeter of primary panel 40. In one example, primary panel 40 is substantially circular in overall shape. Skirt 42 extends around primary panel 40 such that skirt 42 is positioned a consistent distance away from a center axis 50 of primary panel 40, and of lid 22 as a whole, about a substantial entirety of its circumference. Skirt 42 terminates in a bottom edge 44 opposite primary panel 40. In one example, skirt 42 further includes threads 48 extending radially inwardly from an interior surface 46 thereof, as best illustrated in FIG. 2. Threads 48 are configured to securely and rotatably interface with threads 38 of container 12. While illustrated as including threads 48 on interior surface 46 of skirt 42, in other examples, threads 48 may be formed on an exterior surface 52 of skirt 42, opposite interior surface 46, whichever location will interface with threads 38 of container. In other example, threads 38 and 48 are supplemented or replaced with other means for rotatably securing closure 14 to container 12, wherein such means release closure 14 from container 12 when rotational forces are applied thereto.

Primary panel 40 defines a substantially planar, top surface 58 facing in an opposite direction as skirt 42. In one embodiment, coupling pin 26 extends upwardly, that is, further away from bottom edge 44 of skirt 42, with a substantially circular cross-sectional shape. Coupling pin 26 is positioned on primary panel 40 such that a center axis 62 of coupling pin 26 is offset from center axis 50 of primary panel 40, and of lid 22 as a whole, in one example. In this manner, coupling pin 26 is positioned closer to an outermost perimeter 64 (see FIG. 6) of lid 22 than to center axis 50 of lid 22. In one embodiment, coupling pin 26 is topped with a cap 60 that has a larger outside diameter than a shaft 65 of coupling pin 26.

In one embodiment, primary panel 40 additionally defines a groove 66 spaced from and curved about coupling pin 26 such that, in one example, groove 66 maintains a consistent radial spacing from coupling pin 26 about a substantial entirety of its length. Groove 66 is thereby in the shape of an arc having two opposing, curved and elongated sidewalls 72 and 74 terminating at each of first end wall, otherwise referred to as first stop 68, and second end wall, otherwise referred to as second stop 70, just before groove 66 would otherwise interface with skirt 42. Each of first stop 68 and second stop 70 serve to limit movement, more particularly, rotation of lever 24 about coupling pin 26, as will be further described below. In one example, groove 66 extends along an arc about a central angle equal to at least about 120°, and in one embodiment, equal to at least about 180°, subject to a desired amplification factor. The central angle of the arc of groove 66 is, in one example, further increased and/or maximized to gain additional mechanical advantage, where the torsional force and consequential shear stress are able to be resisted by the chosen material(s) forming lid 22 and lever 24.

Lid 22 is formed as a single piece, in one embodiment; while in other embodiments, lid 22 is formed as two pieces including an exterior shell and an interior snap in threaded portion, as will be apparent to those of skill in the art upon reading this application. Lid 22 may be formed of any suitable material. In one example, lid 22 is molded from a moldable material, such as polypropylene or polyvinyl chloride, and may or may not be formed of recyclable material. Where lid 22 may be used with a container 12 housing a food item, lid 22 is formed of a material rated as "food grade."

Figure 4:
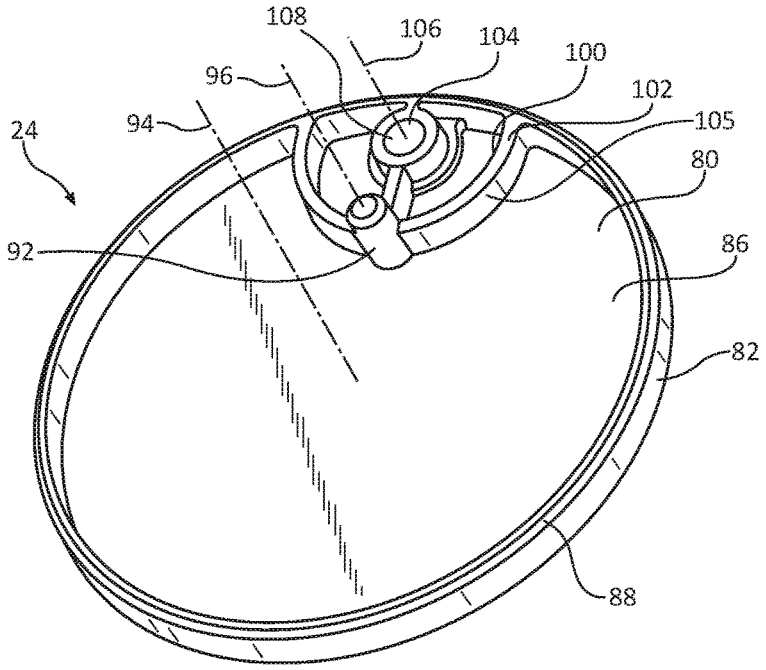
FIG. 4 is a bottom perspective view illustration of the lever of the closure of FIG. 1, according to one embodiment of the present invention.

One example of lever 24 is collectively illustrated in FIGS. 1, 2, and 4. Lever 24 includes a primary panel 80 and sidewall 82 extending downwardly from primary panel 80, substantially adjacent to an outer perimeter of primary panel 80. Primary panel 80 is substantially planar, in one example, defining a top surface 84 and a bottom surface 86 opposite top surface 84. In one example, lever 24 is and shaped sized to be substantially identical in outside diameter to lid 22 such that skirt 42 and sidewall 32 substantially align when lever 24 is in the storage position, as illustrated in FIG. 1, providing a clean overall aesthetic to closure 14. However, in other examples, lever 24 is sized with a smaller overall footprint than lid 22. An aperture 90 extends through primary panel 80 near sidewall 82, that is, such that a center of aperture 90 is offset from centerline 94 of lever 24 and such that aperture 90 will align with coupling pin 26 upon assembly of closure, as will be described below.

Sidewall 82 extends around primary panel 40 such that sidewall 82 is positioned a consistent distance away from a center axis 50 thereof about a substantial entirety of its circumference, in one embodiment. Sidewall 82 terminates in a bottom edge 88 below bottom surface 86 of primary panel 40. In one example, a peg 92, such as a peg follower, protrudes downwardly from bottom surface 86 of primary panel 40. Peg 92, more particularly, extends downwardly from bottom surface 86 a further distance than sidewall 82, such that peg 92 extends well below bottom edge 88 of sidewall. Otherwise stated, in one embodiment, peg 92 extends further downwardly than a remainder of lever 24. In one embodiment, peg 92 extends further downwardly than bottom edge 88 a distance substantially equal to a depth of groove 66 in lid 22. In one example, peg 92 is substantially cylindrical and has an overall outside diameter substantially equal to, e.g., just slightly smaller than, a width of groove 66 defined between sidewalls 72 and 74 such that peg 92 fits within and is movable along groove 66. As illustrated in FIG. 4, peg 92 is positioned on bottom surface 86 of primary panel 80 of lever 24 such that a centerline 96 of peg 92 extends through a single radial line extending from centerline 94 of lever through centerline 106 of aperture 90.

In one example, lever 24 includes one or more internal wall 100 extending downwardly from bottom surface 86 of primary panel 80 to a bottom edge 102 of each internal wall 100, where each internal wall 100 is positioned within the confines of sidewall 82 providing additional rigidity to lever 24. As illustrated, the one or more internal walls 100 includes a cavity internal wall 104 extending about the outside diameter of aperture 90 to form a tubular cavity 108 open at a top, via aperture 90, and a bottom thereof. In one example, an internal wall 105 extends from two different points along sidewall 82 to different sides of peg 92 to increase the rigidity of peg 92. Other internal walls 100 are contemplated as well as the elimination of some or all of internal walls 100.

In other embodiments, lever 24 may have other suitable shapes, such as an oval, square, rectangle, star, insignia, etc., as will be apparent to those of skill in the art upon reading this application. While illustrated and described above as forming lever 24 with primary panel 80 and sidewall 82, in other embodiments, lever 24 is formed of a substantially solid piece of material where bottom edge 88 and bottom surface 86 are substantially coplanar with peg 92 extending below bottom surface 86. In these embodiments, internal walls 100 may be eliminated with tubular cavity 108 being formed through the thickness of substantially solid lever 24. Other variations are also contemplated.

Lever 24 is formed as a single piece, in one embodiment; while in other embodiments, lever 24 is formed as two or more pieces fit together. Lever 24 may be formed of any suitable material. In one example, lever 24 is molded from a moldable material, such as polypropylene or polyvinyl chloride, and may or may not be formed of recyclable material. Where lever 24 may be used with a container 12 housing a food item, lever 24 may be "food grade" rated; however, since lever 24 is spaced from an interior of container 12 via lid 22, lever 24 may be an non "food grade" material even where closure 14 is configured for or will be used with a container 12 housing food or any other ingestible item.

Closure 14 is assembled by rotatably coupling lever 24 to lid 22. More specifically, tubular cavity 108 and peg 92 of lever 24 are aligned with and positioned to face coupling pin 26 and groove 66, respectively. Lever 24 and lid 22 are pressed toward each other moving peg 92 into groove 66, and coupling pin 26 into and, in one example, through tubular cavity 108. Different formations of coupling pin 26 are contemplated that slightly impact assembly of closure 14. In one example, cap 60 on top of coupling pin 26 and tubular cavity 108 are configured to flex sufficiently under pressure to allow coupling pin 26 to move through tubular cavity 108, only to expand once past aperture 90 to at least slightly interact with primary panel 80 holding lever 24 in place between primary panel 80 and cap 60 of coupling pin. 26. In other examples, cap 60 may be initially formed separately from shaft 65 of coupling pin 26 and secured to a top thereof after lever 24 is placed to extend around coupling pin 26.

Figure 5:
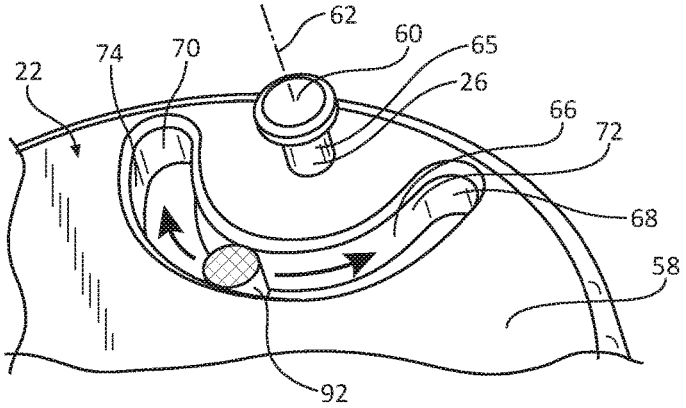
FIG. 5 is a detailed view illustration of the lid of FIG. 3 including a portion of a peg of the lever, according to one embodiment of the present invention.
Figure 6:
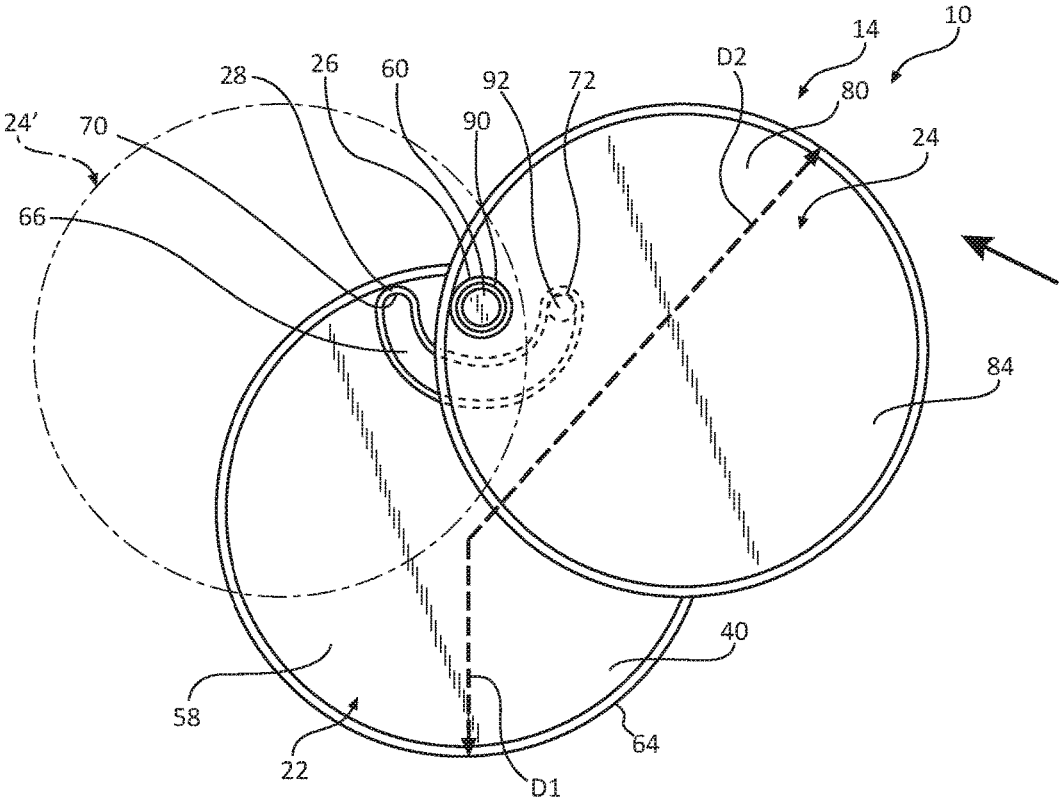
FIG. 6 is a top view illustration of the closure of FIG. 1, with the lever in a use position, according to one embodiment of the present invention.

When so assembled, lever 24 fits atop lid 22 adjacent top surface 58, for example, such that bottom edge 88 faces and/or sits in contact with top surface 58 of primary panel 40 of lid 22. Lid 22 may be rotated into a storage position (see FIG. 1) in which lever 24 fits substantially entirely within a footprint of lid 22, as defined by an outermost perimeter of lid 22. Lever 24 rotates to selectively contact one or both of first and second stops 68 and 70. Lever 24 is rotatable about coupling pin 26 along an arc limited by first and second stops 68 and 70 of groove 66 to a use position (FIGS. 2 and 6), in which lever 24 extends beyond the confines of the footprint of lid 22. As illustrated via the arrows in FIG. 5, when lever 24 is rotated about coupling pin 26, peg 92 moves accordingly within groove 66. As shown in FIG. 6, for example, when lever 24 is rotated in a counterclockwise manner, peg 92 moves through groove 66 until peg 92 contacts second stop 72. When peg 92 hits second stop 72, lever 24 can no longer be rotated about lid 22. Additional force is then applied (as generally indicated via the arrow in FIG. 6) to lever 24 and is transferred from lever 24 to lid 22 via peg 92 and second stop 72. When lid 22 is secured on container 12, as shown in FIGS. 1 and 2, the force transferred to lid 22 initiates rotation of lid 22 about open top 34 of container 12 in a counterclockwise direction moving lid 22 up and eventually off of container threads 38 to open container 12.

The overall force required to open container 12 using closure 14 as described above is decreased from conventional lids 22, as lever 24 of closure 14 increases the distance between the force being applied and center axis 50 of lid 22 about open top 34 of container 12. An increase in this distance, in turn, increases the torque applied to lid 22 rotate lid 22 relative to container 12, as torque is the product of force applied and a distance from the center axis 62 at which that force is applied. More specifically, as shown in FIG. 6, a distance $D_1$ is defined between an outside surface of lid 22 and a center axis 50 of lid 22 about container 12 (FIGS. 1 and 2). Distance $D_1$ is the distance at which force would be applied to a typical lid (not shown) not making use of the present innovation. When lever 24 is rotated into a use position, in which peg 92 is in contact with second stop 72 of lid 22, the force applied to an outside of lever 24 is positioned a distance $D_2$ from center axis 50 of lid 22. The increase between distance $D_1$ and distance $D_2$ proportionally increases the effect of the applied force, such that a lesser force applied at $D_2$ is needed to initiate rotation of lid 22 about container 12 than a force applied at $D_1$. In this manner, when a force is applied to outer regions of lever 24, as generally indicated via the arrow in FIG. 6, that force is amplified, such that lid 22 is more easily removed from container 12, than when an equal force is applied directly to an exterior of lid 22. In one example, distance $D_2$ is at least about 1.5 times distance $D_1$, and, in one example, at least about 2 times distance $D_1$, such that the force applied to lever 24, in the use position, is amplified by at least about 1.5, and, in one example, at least about 2 times, a similar force applied directly to lid 22. Otherwise stated, lever 24 serves to amplify the effect of applied force resulting in a larger amount of torque being applied to lid 22 per the amount of force applied to lever 24.

While primarily illustrated as rotating lever 24 counterclockwise from a storage position (FIG. 1) to a use position (FIGS. 2 and 6) to open lid 22, closure 14 also facilitates a user in tightly resealing container 12. In this manner, closure 14 provides bi-directional force amplification. More specifically, rotating lever 24 about coupling pin 26 in a clockwise direction eventually moves peg 92 into contact with first stop 70 of groove 66 as generally indicated in phantom lines as lever 24' in FIG. 6. Forces applied to lever 24 to continue moving lever 24 in a clockwise direction are transferred to lid 22 via peg 92 interaction with first stop 70, in substantially an identical manner as described above in the opening use position other than being in an opposite direction. The transfer of forces allows a user to tighten lid 22 on container 12 with lesser force than would otherwise be needed due to the increased distance $D_2$ of lever 24 as compared to distance $D_1$ of lid 22 alone. Lever 24 is easily rotated back into a storage position from either of the two use positions, that is, from an opening use position (see FIGS. 2 and 6) and a closing use position generally indicated in phantom lines in FIG. 6. As such, a compact overall container assembly 10 is provided having a built in lever 24 of closure 14 rotatable to aid a user in more easily opening and closing container 12 via rotation of closure relative to container 12.

Figure 7:
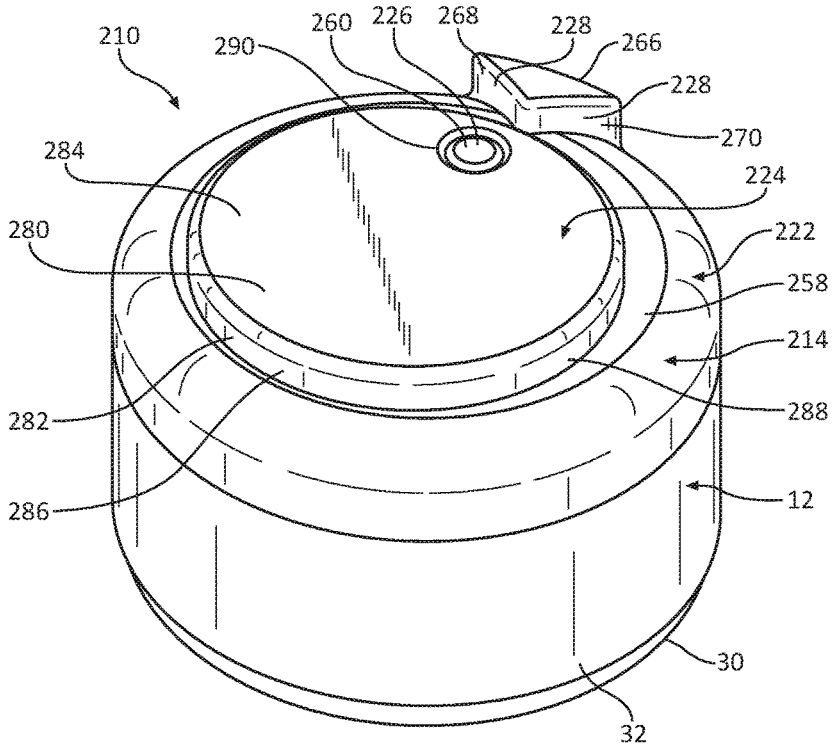
FIG. 7 is a front perspective view illustration of a container assembly including a closure having a lever in a storage position, according to one embodiment of the present invention.
Figure 8:
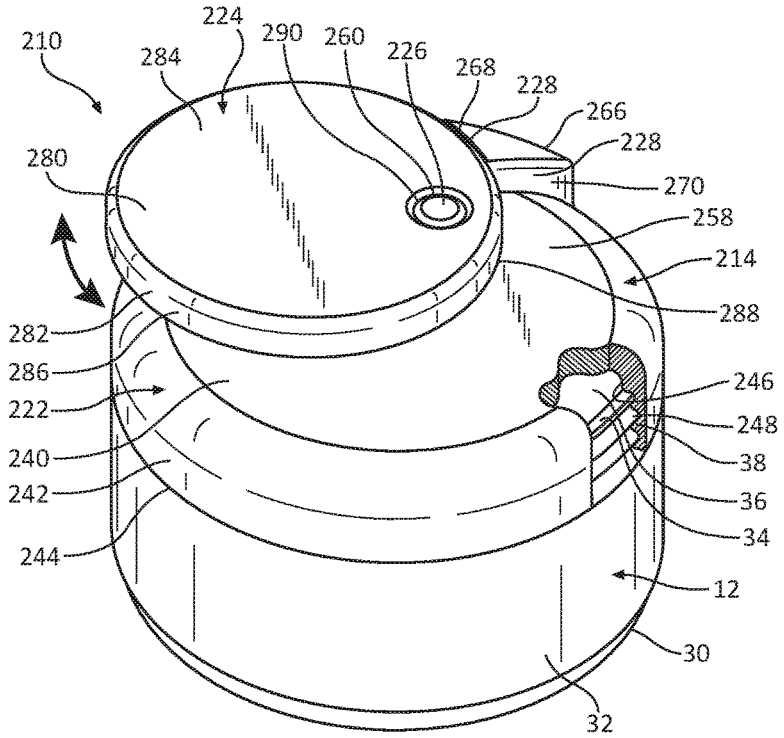
FIG. 8 is a front perspective view illustration of the container assembly of FIG. 7 where the lever is in a use position, according to one embodiment of the present invention.

FIGS. 7 and 8 illustrate a perspective view illustration of a container assembly 210 including container 12 and a closure 214, according to one embodiment of the invention. In general, closure 214 includes a lid 222 covering, or being configured to cover, and rotatably coupled to container 212. Closure 214 further includes a lever 224 coupled to a top of lid 222, for example, about a coupling pin 226. Lever 224 is rotatable about coupling pin 226 between a storage position and a use position. In the storage position, lever 224 is maintained within an overall footprint of lid 222, such that lever 224 does not change the amount of shelf space needed to store container assembly 210. When rotated about coupling pin 226 to the storage position, lever 224 extends at least partially outside the overall footprint of lid 222. Lid 222 includes at least one stop 228 configured to interact with lever 224 to stop rotational movement of lever 224 about coupling pin 226, such that force applied to lever 224 is transferred to lid 222, thereby rotating lid 222 relative to container 12 and eventually removing lid 222 from container 12. Although container assembly 310 is illustrated with one example container 12, it should be understood that many differently sized and shaped containers, such as jars, bottles, etc. are contemplated and acceptable for use with this current innovation.

Figure 9:
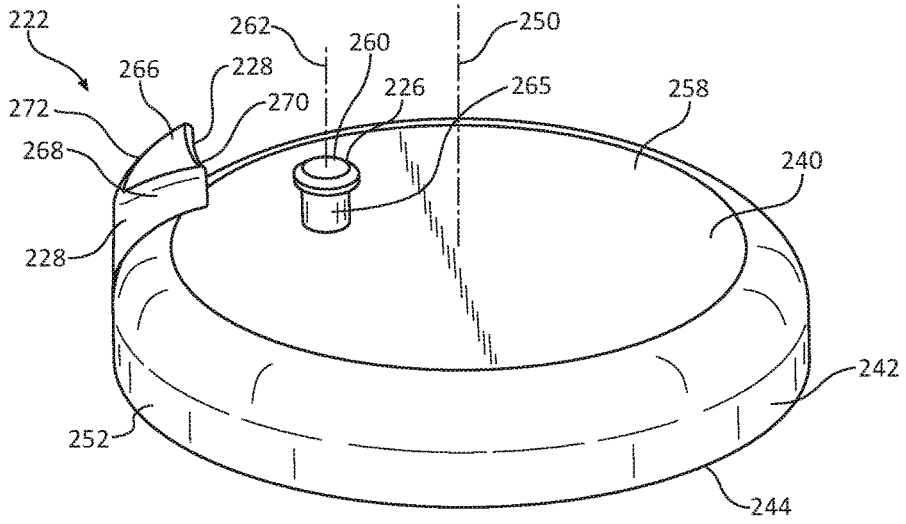
FIG. 9 is a front perspective view illustration of a lid of the closure of FIG. 1, according to one embodiment of the present invention.
Figure 10:
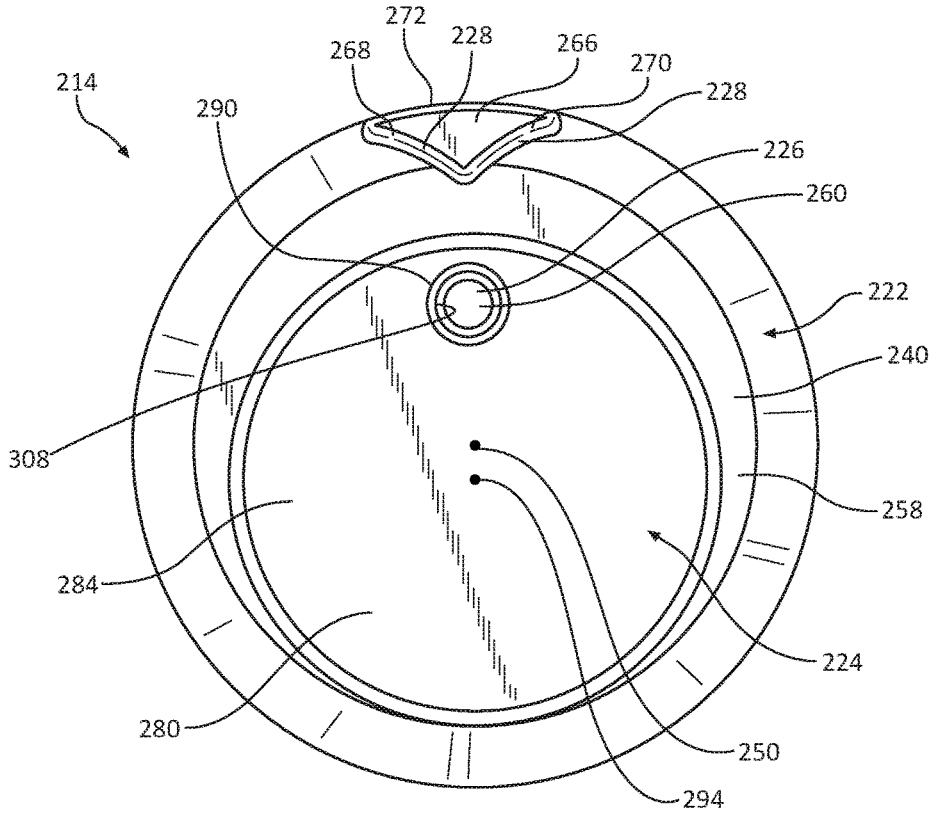
FIG. 10 is a top view illustration of the container assembly of FIG. 7 with the lever in the storage position, according to one embodiment of the present invention.

One example of closure 214 including lid 222 and lever 224 is also illustrated in FIGS. 7 and 8. Additionally referring to the isolated view of lid 222 in FIG. 9, in one embodiment, lid 222 includes a primary panel 240 and depending skirt 242 extending downwardly from primary panel 240, substantially adjacent to an outer perimeter of primary panel 240. In one example, primary panel 240 is substantially circular in overall shape. Skirt 242 extends around primary panel 240 such that skirt 242 is positioned a consistent distance away from a center axis 250 of primary panel 240, and of lid 222 as a whole, about a substantial entirety of its circumference. Skirt 242 terminates in a bottom edge 244 opposite primary panel 240. In one example, skirt 242 further includes threads 248 extending radially inwardly from an interior surface 246 thereof, as best illustrated in FIG. 2. Threads 248 are configured to securely and rotatably interface with threads 38 of container 12. While illustrated as including threads 248 on interior surface 246 of skirt 242, in other examples, threads 248 may be formed on an exterior surface 252 of skirt 242, opposite interior surface 246, whichever location will interface with threads 38 of container 12. In other examples, threads 38 and 248 are supplemented or replaced with other means for rotatably securing closure 214 to container 12, wherein such means release closure 214 from container 12 when rotational forces are applied thereto.

Primary panel 240 defines a substantially planar, top surface 258 facing in an opposite direction as skirt 242. In one embodiment, coupling pin 226 extends upwardly, that is, further away from bottom edge 244 of skirt 242, from primary panel 220 with a substantially circular cross-sectional shape. Coupling pin 226 is positioned on primary panel 240 such that a center axis 262 of coupling pin 226 is offset from center axis 250 of primary panel 240, and of lid 222 as a whole, in one example. In this manner, coupling pin 226 is positioned between an outermost perimeter 264 (see FIG. 11) of lid 222 and center axis 250 of lid 222. In one embodiment, coupling pin 226 is topped with a cap 260 that has a larger outside diameter than a shaft 265 of coupling pin 226.

In one embodiment, lid 222 includes a protruding block 266 extending upwardly from a top surface 258 of primary panel 240 in a substantially triangular or pie shape. As illustrated, protruding block 266 has an exterior wall 272 adjacent, for example, immediately adjacent, outermost perimeter 264 of lid 222. First and second sidewalls 268 and 270 each extend from opposite ends of exterior wall 272 to intersect one another at a point radially inward from exterior wall 272, and in one example, the intersection is the nearest part of the protruding block to center axis 250 of lid 222. Each of first and second sidewalls 268 and 270 is formed with a similar concave curvature, with the degree of curvature matching an outside curvature of lever 224, such that each of first and second sidewalls 268 and 270 form one of stops 228 of closure 214. Each of first stop 268 and second stop 270 serve to limit movement, more particularly, rotation of lever 224 about coupling pin 226, as will be further described below. In one embodiment, protruding block may eliminate one of first stop 268 and second stop 270 to only amplify force in one of a closing and opening direction.

Lid 222 is formed as a single piece, in one embodiment; while in other embodiments, lid 222 is formed as two pieces including an exterior shell and an interior snap in threaded portion, as will be apparent to those of skill in the art upon reading this application. Lid 222 may be formed of any suitable material. In one example, lid 222 is molded from a moldable material, such as polypropylene or polyvinyl chloride, and may or may not be formed of recyclable material. Where lid 222 may be used with a container 12 housing a food item, lid 222 is formed of a material rated as "food grade."

One example of lever 224 is collectively illustrated in FIGS. 7, 8, 10, and 11. Lever 224 includes a primary panel 280 and sidewall 282 extending downwardly from primary panel 820, substantially adjacent to an outer perimeter of primary panel 280. Primary panel 280 is substantially planar, in one example, defining a top surface 284 and a bottom surface 286 opposite top surface 284. In one example, lever 224 is and shaped sized to be smaller in outside diameter to lid 222 such that lever 224 does not increase an overall footprint of closure 14 as defined by lid 222. An aperture or depending open cavity 290 extends through primary panel 280 near sidewall 282, that is, such that a center of cavity 290 is offset from centerline 294 of lever 224.

Sidewall 282 extends around and depends downwardly from primary panel 240. In an embodiment where lever 224 is circular, sidewall 282 is positioned a consistent distance away from a center axis 250 thereof about a substantial entirety of its circumference. Sidewall 282 terminates in a bottom edge 288 below bottom surface 286 of primary panel 240. In other embodiments, lever 224 may have other suitable shapes, such as an oval, square, rectangle, star, etc., as will be apparent to those of skill in the art upon reading this application. While illustrated and described above as forming lever 224 with primary panel 280 and sidewall 282, in other embodiments, lever 224 is formed of a substantially solid piece of material where bottom edge 288 and bottom surface 286 are substantially coplanar with each other. Other variations are also contemplated.

Lever 224 is formed as a single piece, in one embodiment; while in other embodiments, lever 224 is formed as two or more pieces fit together. Lever 224 may be formed of any suitable material. In one example, lever 224 is molded from a moldable material, such as polypropylene or polyvinyl chloride, and may or may not be formed of recyclable material. Where lever 224 may be used with a container 12 housing a food item, lever 224 may be "food grade" rated; however, since lever 224 is spaced from an interior of container 12 via lid 222, lever 224 may be an non "food grade" material even where closure 214 is configured for or will be used with a container 12 housing food or any other ingestible item.

Closure 214 is assembled by rotatably coupling lever 224 to lid 222. More specifically, cavity 290 of lever 224 is aligned with and positioned to face coupling pin 226. Lever 224 and lid 222 are pressed toward each other moving coupling pin 226 into and through cavity 290. Different formations of coupling pin 226 are contemplated that slightly impact assembly of closure 14. In one example, cap 260 on top of coupling pin 226 and cavity 290 are configured to flex sufficiently under pressure to allow coupling pin 226 to move through cavity 290, where cap 260 expands to its original diameter once cap 260 clears cavity 290 to at least slightly interact with primary panel 280 holding lever 224 in place between primary panel 280 and cap 260 of coupling pin. 226. In other examples, cap 260 may be initially formed separately from shaft 265 of coupling pin 226 and secured to a top thereof after lever 224 is placed to extend around coupling pin 226.

Figure 11:
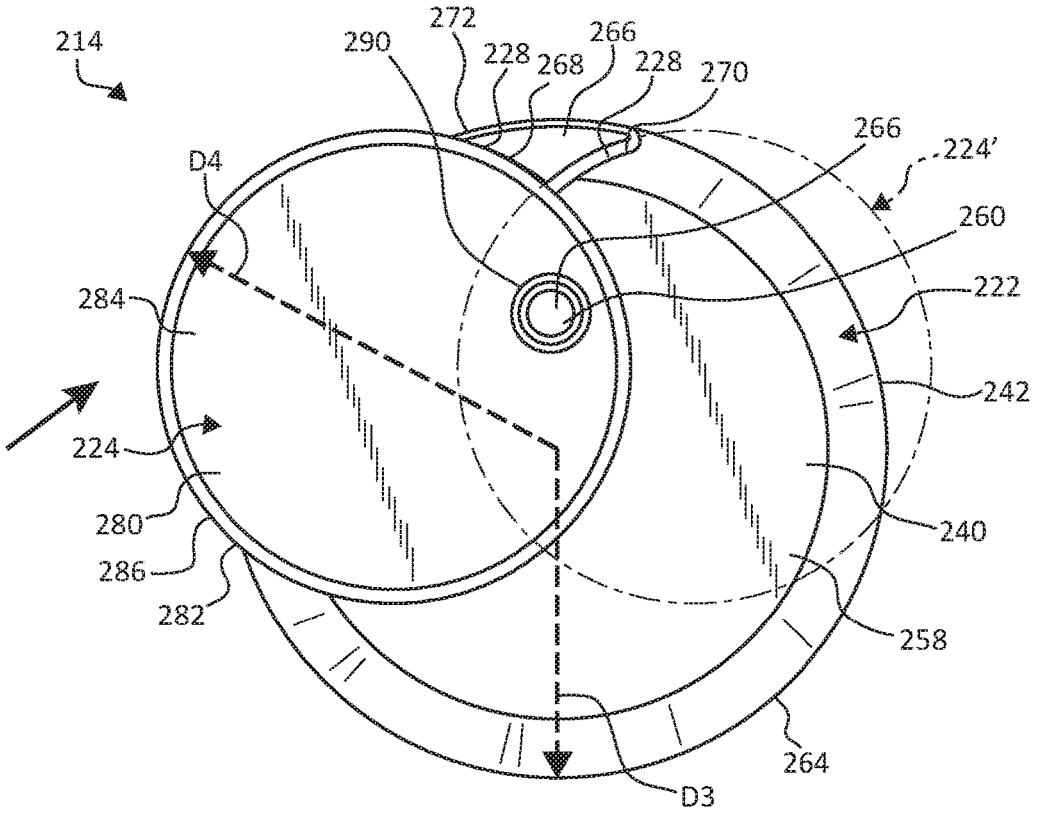
FIG. 11 is a top view illustration of the container assembly of FIG. 7 with the lever in the use position, according to one embodiment of the present invention.

When so assembled, lever 224 fits atop lid 222 adjacent top surface 258 of lid 222 adjacent top surface 58, for example, such that bottom edge 88 faces and/or sits in contact with top surface 58 of primary panel 40 of lid 22. Lid 22 may be rotated into a storage position (see FIGS. 7 and 10) in which lever 224 fits substantially entirely within a footprint of lid 222, as defined by an outermost perimeter of lid 222. Lever 224 is selectively rotatable about coupling pin 226 in each of two directions, as generally indicated by the arrow in FIG. 8, to selectively contact each of the first and second stops 268 and 270. In one example, lever 224 is rotated along an arc limited by at least one of first and second stops 268 and 270 of protruding block 266 to a use position (FIGS. 8 and 11), in which lever 224 extends beyond the confines of the footprint of lid 222. As shown in FIG. 11, for example, when lever 224 is rotated in a clockwise manner, sidewall 282 of lever 224 contacts first sidewall 268, one of stops 228, which prevents further rotation of lever 224 relative to lid 222. Additional force then applied (as generally indicated via the arrow in FIG. 1) to lever 224, and the additional force is transferred from lever 224 via first sidewall 268 to lid 222 to secure and tighten lid 222 on container 12. Once lid 22 is secured to container 12, lever 224 can be moved back to the storage position.

Since, closure 214 provides bi-directional force amplification, when a user wishes to reopen container 12, lever 224 is rotated in the opposite, counterclockwise direction, to interaction with second sidewall 270 as generally indicated in phantom lines at 224' in FIG. 11, in a similar manner as shown in described for first sidewall 268. In this manner, force on lever 224 is transferred to lid 22 via protruding block 266 resulting in counterclockwise rotation of lid 222 about open top 34 of container 12, which moves lid 222 up and eventually off of container threads 38 to open container 12.

As with closure 14, the overall forces required to tighten and open container 12 using closure 214, as described above, are decreased from conventional lids, as lever 224 of closure 214 increases the distance between the force being applied and the center axis 250 of lid 222 about open top 34 of container 12. An increase in this distance, in turn, increases the torque applied to lid 222 rotate lid 222 relative to container 12, as torque is the product of force applied and a distance from the center axis 262 at which that force is applied.

More specifically, as shown in FIG. 11, a distance $D_3$ is defined between an outside surface of lid 222 and a center axis 250 of lid 222 about container 12 (FIGS. 7 and 8). Distance $D_3$ is the distance at which force would be applied to a typical lid (not shown) not making use of the present innovation. When lever 224 is rotated into a use position, the force applied to an outside of lever 224 is positioned a distance $D_4$ from center axis 250 of lid 222. The increase between distance $D_3$ and distance $D_4$ proportionally increases the effect of the applied force, such that a lesser force applied at $D_4$ is needed to initiate rotation of lid 222 about container 12 than a force applied at $D_3$. In this manner, when a force is applied to outer regions of lever 224, as generally indicated with the arrow in FIG. 11, that force is amplified, allowing lid 222 to be more easily removed from container 12, than when an equal force is applied directly to an exterior of lid 222.

In one example, distance $D_4$ is at least about 1.2 times distance $D_3$, and, in one example, at least about 1.5 times distance $D_3$, such that the force applied to lever 224, in the use position, is amplified by at least about 1.2, and, in one example, at least about 1.5 times, a similar force applied directly to lid 222. Otherwise stated, lever 224 serves to amplify the effect of applied force resulting in a larger amount of torque being applied to lid 222 per the amount of force applied to lever 224. In one example, the amplification factor on the force applied to the lever as compared to an equal force applied to the lid is equal to at least about 1.2, and, in one example, equal to at least about 1.5.

Lever 224 is easily rotated back into a storage position from either of the two use positions, that is, from a closing use position (see FIGS. 8 and 11) and an opening use position generally indicated at 224' in FIG. 11. As such, a compact overall container assembly 210 is provided having a built in lever 224 of closure 14 rotatable to aid a user in more easily opening and closing container 12 via rotation of closure relative to container 12.

Figure 12:
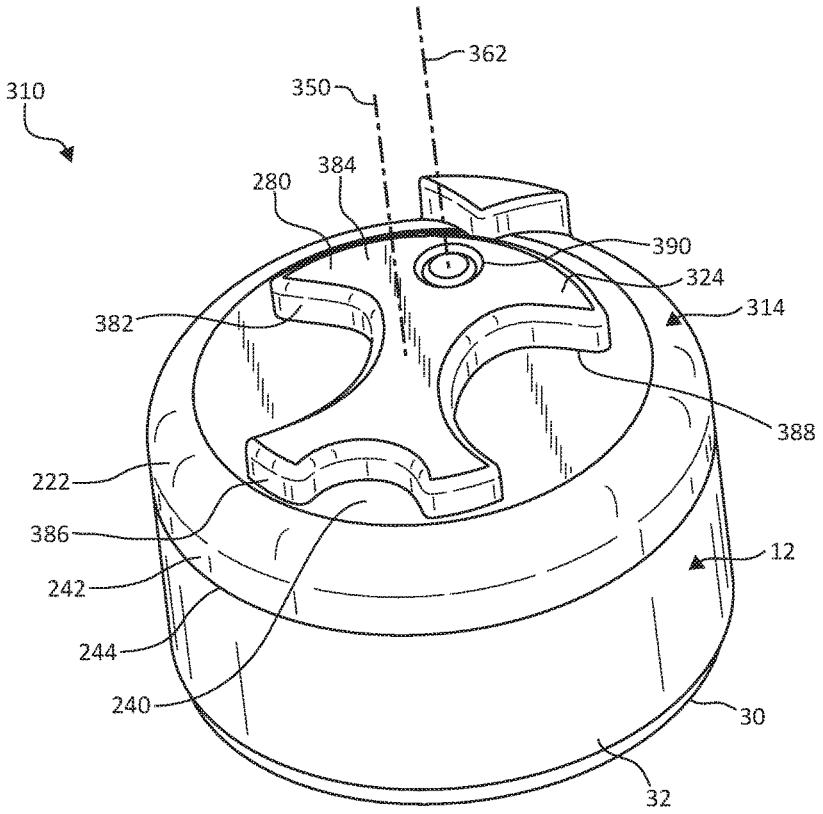
FIG. 12 is a front perspective view illustration of a container assembly including a closure having a lever in a storage position, according to one embodiment of the present invention.
Figure 13:
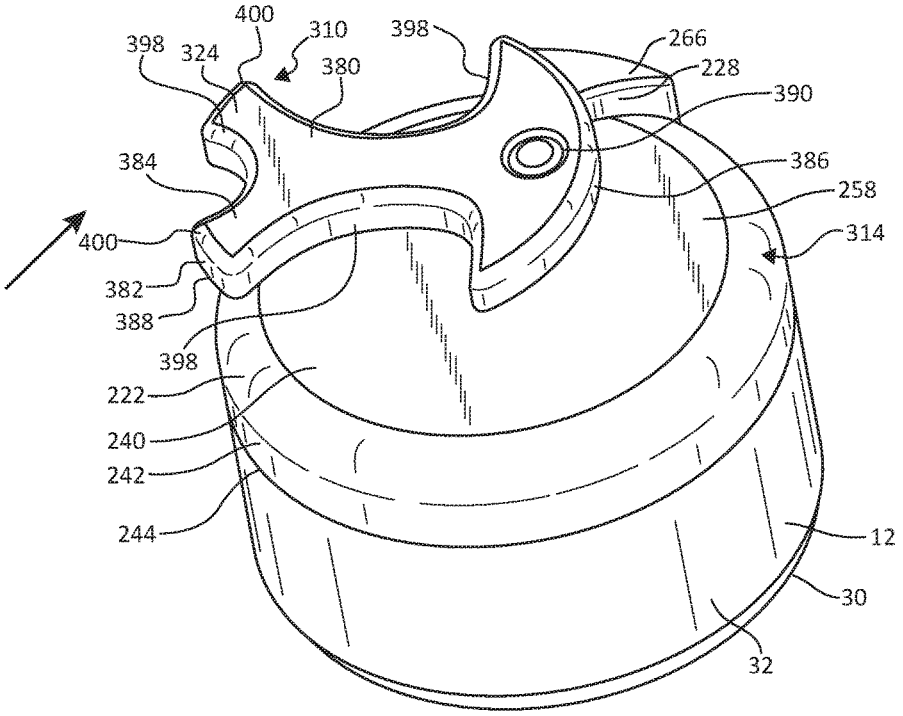
FIG. 13 is a front perspective view illustration of the container assembly of FIG. 12 where the lever is in a use position, according to one embodiment of the present invention.

FIGS. 12 and 13 illustrate another embodiment of a container assembly at 310. Container assembly 310 is identical to container assembly 210, other than lever 324 replacing lever 224 of container assembly 210. Lever 324 is substantially similar to lever 224 other than an overall shape thereof. More particularly, in one example, lever 324 includes a primary panel 380 and sidewall 382 extending downwardly from primary panel 380, substantially adjacent to an outer perimeter of primary panel 380. Primary panel 380 is substantially planar, in one example, defining a top surface 384 and a bottom surface 386 opposite top surface 384. In one example, lever 324 is and shaped sized to be smaller in overall size than lid 322 such that lever 324 does not increase an overall footprint of closure 14 as defined by lid 322, and primary panel 380 is sized and shaped accordingly.

In one embodiment, primary panel 380 is of any suitable shape and provides an alternative to the circular shape of primary panel 280 (e.g. FIG. 7). Primary panel 380 is sized and shaped to fit substantially within a footprint of lid 322, and, in one example, to fit substantially within a footprint of primary panel 240 of lid 222 when lever 324 is rotated to a use position, as shown in FIG. 13. In addition, primary panel 380 is sized such that when lever 324 is rotated to a use position, lever 324 will extend outwardly beyond an overall footprint of lid 322. In one example, when in the use position, lever 324 is sized and shaped to extend a distance away from a centerline 350 of lid 322 that is at least 1.2 times, and in one embodiment, at least 1.5 times, a distance from centerline 350 of lid 322 to an outside surface of skirt 242 of lid 322. Primary panel 380 may be shaped as a standard geometric shape, such as an oval, polygon, etc. or may be shaped in a less standard shape, such as that illustrated in FIGS. 12 and 13. In this manner, primary panel 380 may define any number of concavities or other indentations 398 or convexities or other protrusions 400.

In one embodiment, the shape of primary panel 380 may be representative of a source, user, contents, or other component of container assembly 310 or the items or products maintained therein. For example, primary panel 380 may be in shape of a product logo, source logo, container logo, a well-known character, a user's initial, or other shape having additional meaningful significance. While the non-circular shape of lever 324 is shown here as a specific alternative to lever 224 of FIGS. 7 and 8, it should be understood that a similarly shaped lever could be substituted for levers in the other embodiments described in this application as well. In one example, curvature in the shape of primary panel 380 is maintained at portions that will be adjacent protruding block 266 to nest with first and second sidewalls 268 and 270 as described above with respect to closure 212. In one example, the shape of primary panel 380 that will be adjacent protruding block 266 are otherwise shaped and/or the contour of first and second sidewalls 268 and 270 are adjusted accordingly such that lever 324 will still nest with first and second sidewalls 268 and 270 as stops 228.

Primary panel 340 additionally defines an aperture or depending cavity 390 extending through primary panel 380 near sidewall 282, that is, such that a center of cavity 290 is offset from centerline 294 of lever 224. Cavity 490 is sized and shaped to fit around coupling pin 226 allowing rotation of lever 324 about coupling pin 226.

Sidewall 382 extends around and depends downwardly from an outer perimeter of primary panel 340. Sidewall 382 terminates in a bottom edge 388 below bottom surface (not shown) of primary panel 380. Since sidewall 382 follows the general shape of primary panel 340, in one embodiment, portions of sidewall 382 corresponding with concavities or other indentations 398 may provide surfaces for easier grip or contact by a user's hand or individual fingers thereon. While illustrated and primarily described as forming lever 324 with primary panel 380 and sidewall 382, in other embodiments, lever 324 is formed of a substantially solid piece of material where bottom edge 388 and the bottom surface of primary panel 380 are substantially coplanar with each other. Other variations are also contemplated.

Like lever 224, lever 324 is formed as a single piece, in one embodiment; while in other embodiments, lever 324 is formed as two or more pieces fit together. Lever 324 may be formed of any suitable material. In one example, lever 324 is molded from a moldable material, such as polypropylene or polyvinyl chloride, and may or may not be formed of recyclable material. Where lever 324 may be used with a container 12 housing a food item, lever 324 may be "food grade" rated; however, since lever 324 is spaced from an interior of container 12 via lid 222, lever 324 may be an non "food grade" material even where closure 314 is configured for or will be used with a container 12 housing food or any other ingestible item.

Closure 314 is assembled by rotatably coupling lever 324 to lid 322, in the same manner as described above for lever 224 and lid 222. More specifically, cavity 490 of lever 324 is aligned with and positioned to face coupling pin 326. Lever 324 and lid 222 are pressed toward each other moving coupling pin 226 into and through cavity 490 such that cap 260 of pin 226 fits over primary panel 380 around cavity 490. In this manner closure 314 functions substantially similarly to closure 214, providing bi-directional force amplification to opening and closing forces applied to lever 324 of lid 322. That is force on lever 324 is transferred to lid 222 via protruding block 266 resulting in either clockwise or counterclockwise rotation of lid 222, depending on the direction force is applied, about open top 34 of container 12, which either securely seal closure 314 to container 212 or to remove closure 314 from container 212.

Figure 14:
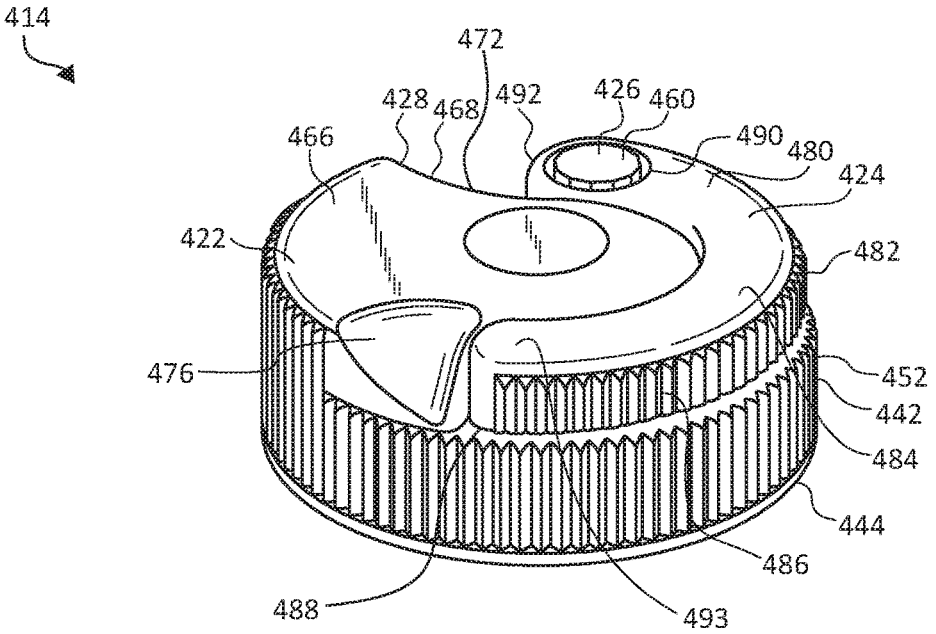
FIG. 14 is a front perspective view illustration of a closure having a lever in a storage position, according to one embodiment of the present invention.
Figure 15:
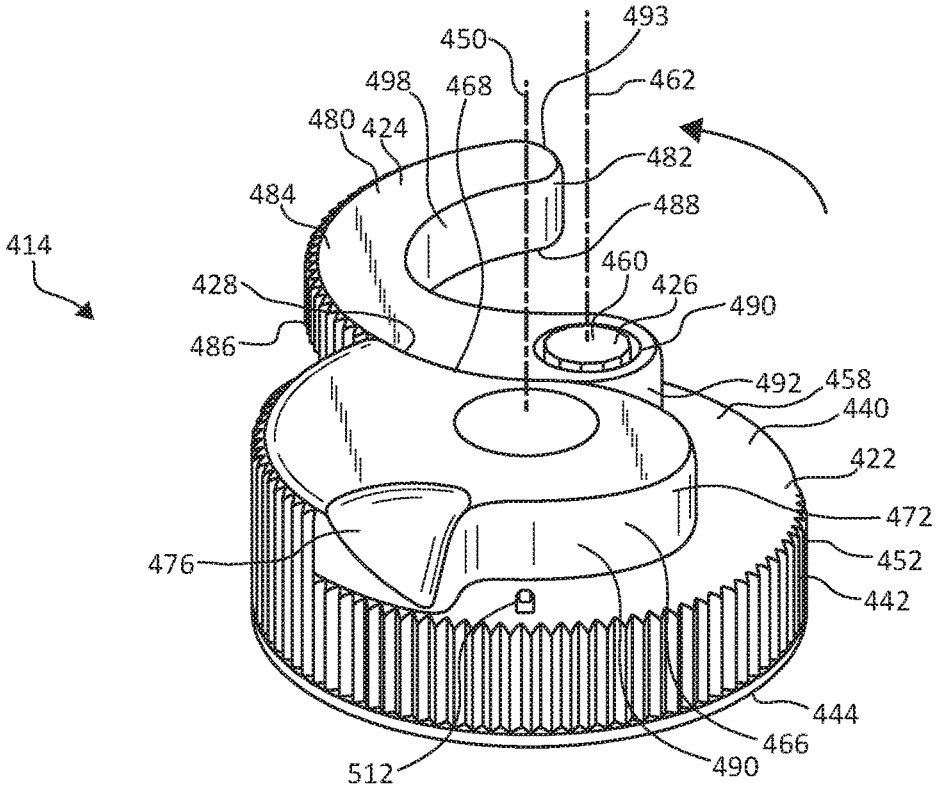
FIG. 15 is a front perspective view illustration the closure of FIG. 14 where the lever is in a use position, according to one embodiment of the present invention.
Figure 16:
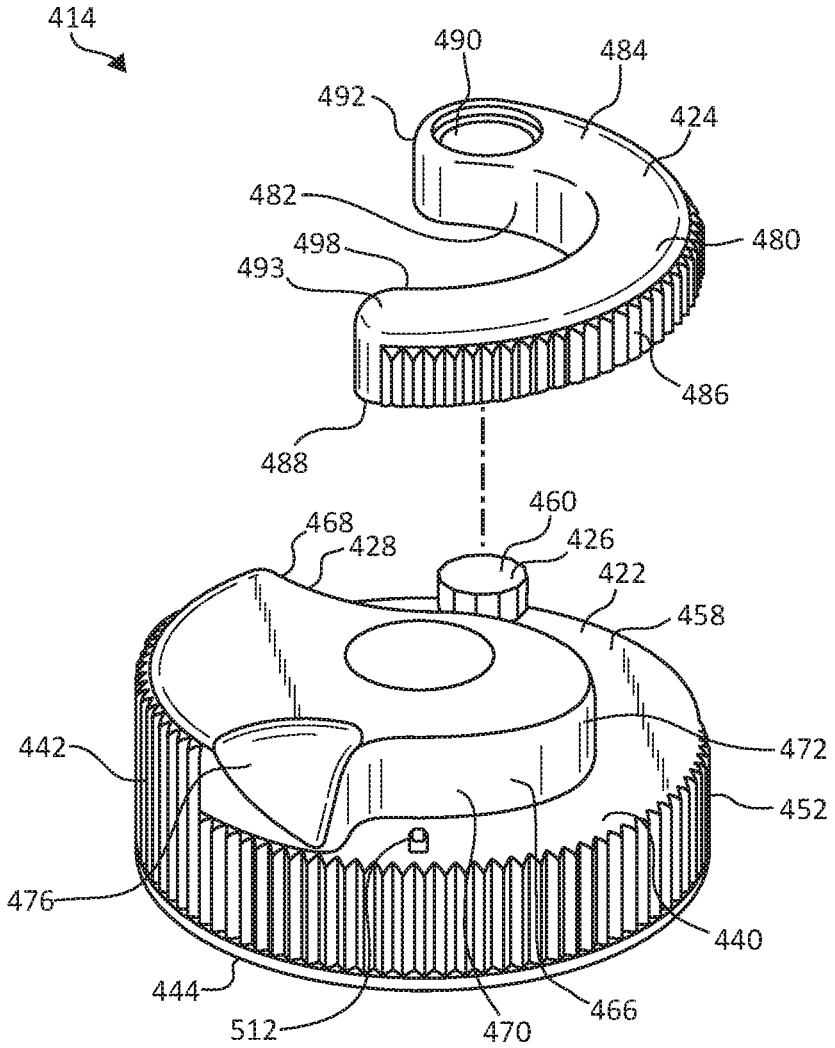
FIG. 16 is an exploded, front perspective view illustration of the closure of FIG. 14, according to one embodiment of the present invention.

FIGS. 14-16 illustrate yet another embodiment of a closure, according to the present invention, at 414 configured for use with container 12 (see, e.g., FIGS. 1 and 2) or any other suitable container. Closure 414 includes a lid 422 covering, or being configured to cover, and rotatably coupled to container 12. Closure 414 further includes a lever 424 coupled to a top of lid 422 about a coupling pin 426. Lever 424 is rotatable about the coupling pin 426 between a storage position (see FIG. 14) and a use position (see FIG. 15). In the storage position, lever 424 is maintained within an overall footprint of lid 422, such that lever 424 does not change the amount of shelf space needed to store any container mated with closure 414. When rotated about coupling pin 426 to the storage position, lever 424 extends at least partially outside the overall footprint of lid 422, in one embodiment. Lid 422 includes at least one stop 428 configured to interact with lever 424 to stop rotational movement of lever 424 about coupling pin 426, such that force applied to lever 424 is transferred to lid 422, thereby rotating lid 422 relative to a corresponding container (not shown) and eventually removing lid 422 from the corresponding container.

In one example, lid 422 of closure 414 includes a primary panel 440 and depending skirt 442 extending downwardly from primary panel 440, substantially adjacent to an outer perimeter of primary panel 440. In one example, primary panel 440 is substantially circular in overall shape. Skirt 442 extends around primary panel 440 such that skirt 442 is positioned a consistent distance away from a center axis 450 of primary panel 440, and of lid 422 as a whole, about a substantial entirety of its circumference. Skirt 442 terminates in a bottom edge 444 opposite primary panel 440. In one example, skirt 442 further includes threads (not shown, but similar to threads 48 and 248 described above) extending radially inwardly from an interior surface (not shown) and configured to securely and rotatably interface with threads 38 of container 12 (see FIG. 2). In other example, threads of lid 422 are supplemented or replaced with other means for securing closure 414 to container 12, wherein such means release closure 414 from container 12 when rotational forces are applied thereto. Skirt 442 may additionally include a series of vertically extending teeth 452 or other grip-enhancing feature, circumferentially spaced from one another along and extending radially outwardly from skirt 442. Teeth 452 provide additional grip enhancement for user interaction with lid 422.

Primary panel 440 defines a substantially planar, top surface 458 facing in an opposite direction as skirt 442. Coupling pin 426 extends upwardly, that is, further away from bottom edge 444 of skirt 442, from primary panel 440 with a substantially circular cross-sectional shape. Coupling pin 426 is positioned on primary panel 440 such that a center axis 462 of coupling pin 426 is offset from center axis 450 of primary panel 440, and of lid 422 as a whole, in one example. In this manner, coupling pin 426 is positioned closer to an outermost perimeter 464 (see FIG. 17) of lid 422 than to center axis 450 of lid 422.

In one embodiment, primary panel 440 additionally defines a protruding block 466 spaced from coupling pin 426. Protruding block 466 defines curved sidewall 472 radially inset form skirt 442. In one example, sidewall 472 includes two adjacent portions, including a first sidewall portion 468 and a second sidewall portion 470. First sidewall portion 468 serves as a first stop and is configured to interact with lever 424, when lever 424 is in the use position (see, e.g., FIG. 17). Second sidewall portion 470 extends from an end of first sidewall portion 468 and is configured to serve as a second stop interfacing with or sitting adjacent lever 424 when lever 424 is in a storage position (see FIG. 14). First sidewall portion 468 serves to limit movement, more particularly, rotation of lever 424 about coupling pin 426 in a counterclockwise direction, as will be further described below.

Protruding block 466 may additionally include a detent or similar indentation 476 along a portion thereof. Indentation 476 is sized to interact with a user's finger providing a surface area for enhancing such interaction, as will be apparent to those of skill in the art upon reading this application.

Lid 422 may be formed as a single piece or as two or more pieces including an exterior shell and an interior snap in threaded portion as will be apparent to those of skill in the art upon reading this application. Lid 422 may be formed of any suitable material. In one example, lid 422 is molded from a moldable material, such as polypropylene or polyvinyl chloride, and may or may not be formed of recyclable material. Where lid 422 may be used with a container 412 housing a food item, lid 422 is formed of a material rated as "food grade."

One example of lever 424 is collectively illustrated in FIGS. 14-16. Lever 424 includes a primary panel 480 and sidewall 482 extending downwardly from primary panel 480, substantially adjacent to and surrounding an outer perimeter of primary panel 480. Primary panel 480 is substantially planar, in one example, defining a top surface 484 and a bottom surface (not shown) opposite top surface 484. In one example, lever 424 is formed in a curvilinear, hook, or crescent shape, as illustrated, forming a first end 492 and a second end 493 of lever 424. In one example, an interior curvature of lever 424 is substantially identical to the curvature of second sidewall portion 470, such that lever 424 is configured to selectively next against second sidewall portion 470. A aperture and/or cavity 490 extends through primary panel 480 near first end 492 of lever 424, that is, such that a center of cavity 490 is offset from centerline 494 of lever 424 and such that cavity 490 will align with coupling pin 426 upon assembly of closure, as will be described below.

Sidewall 482 extends around primary panel 440 about a substantial entirety of an outer perimeter of primary panel 440, in one embodiment. Sidewall 482 extends downwardly away from primary panel 440 and terminates in a bottom edge 488 below bottom surface 486 of primary panel. In one example, a portion of sidewall 482, such as an exterior facing portion, includes vertically extending teeth 486 or other grip-enhancing feature.

While illustrated and described above as forming lever 424 with primary panel 480 and sidewall 482, in other embodiments, lever 424 is formed of a substantially solid piece of material where bottom edge 488 and bottom surface (not shown) of primary panel 480 are substantially coplanar. Other variations are also contemplated.

Lever 424 is formed as a single piece, in one embodiment; while in other embodiments, lever 424 is formed as two or more pieces fit together. Lever 424 may be formed of any suitable material. In one example, lever 424 is molded from a moldable material, such as polypropylene or polyvinyl chloride, and may or may not be formed of recyclable material. Where lever 424 may be used with a container 12 housing a food item, lever 24 may be "food grade" rated however, since lever 424 is spaced from an interior of container 12 (see, e.g., FIGS. 1 and 2) via lid 422, lever 424 may be an non "food grade" material even where closure 414 is configured for or will be used with a container 12 housing food or any other ingestible item.

Closure 414 is assembled by rotatably coupling lever 424 to lid 422. More specifically, cavity 490 is aligned with and positioned to face coupling pin 426. Lever 424 and lid 422 are pressed toward each other moving coupling pin 426 into and, in one example, through cavity 490. In one example, coupling pin 426 and cavity 490 are sufficiently sized to couple to one another via friction fit while still allowing lever 424 to rotate about coupling pin 426.

When so assembled, lever 424 fits atop lid 422 adjacent top surface 458 of lid 422, for example, such that bottom edge 488 of lever 424 fits adjacent and/or abuts top surface 458 of primary panel 440. Lever 424 is rotatable into a storage position (see FIG. 14), in which lever 424 fits substantially entirely within a footprint of lid 422 as defined by an outermost perimeter of lid 422. In one example, when in the storage position, an interior curvature of lever 424 nests directly adjacent second sidewall portion 470 of protruding block, which stops clockwise rotation of lever 424 beyond the storage location nesting against protruding block 466. Lever 424 is rotatable in a counterclockwise direction as generally indicated by the arrow in FIG. 15, away from second sidewall portion 470 of protruding block 466, until exterior side of lever 424 directly abuts first sidewall portion 468 of protruding block 466 placing lever 424 in a user position (FIGS. 15 and 17), in which lever 424 extends beyond the confines of the footprint of lid 422, that is extends beyond an outer perimeter of lid 422. Additional force then applied, as generally indicated via the arrow in FIG. 17, to lever 424, and the additional force is transferred from lever 424 via first sidewall portion 468, acting as a stop 428, to lid 422. When lid 422 is secured on a corresponding container, such as container 12 (see, e.g., FIGS. 1 and 2), the force transferred to lid 222 initiates counterclockwise rotation of lid 222 about open top 34 of container 12 moving lid 422 up and eventually off of container threads 38 (see, e.g., FIG. 2) to open container 12.

Figure 17:
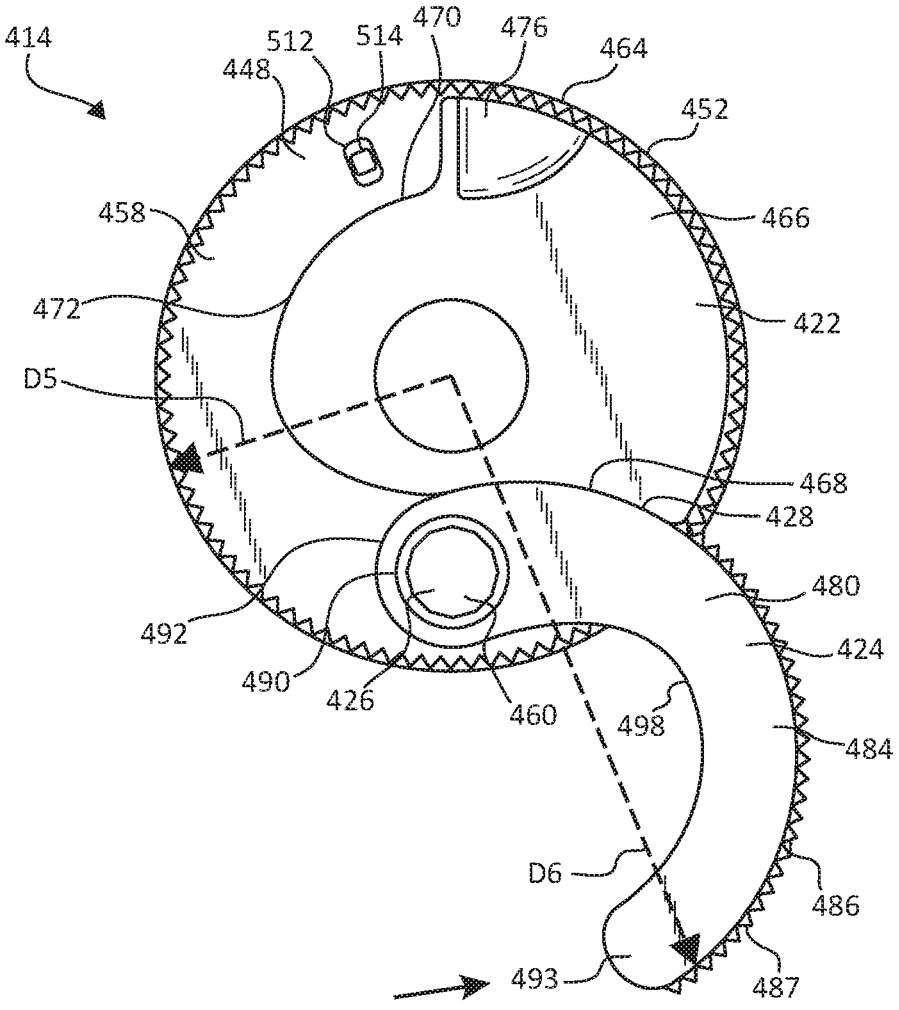
FIG. 17 is a top view illustration of the closure of FIG. 14 when the lever is in the use position, according to one embodiment of the present invention.

The overall force required to open container 12 (see, e.g., FIGS. 1 and 2) is lessened using closure 414 as described above is decreased from conventional lids 22, as lever 424 of closure 414 increases the distance between the force being applied and the center axis 450 of lid 422 about open top 34 of container 12. In a similar manner as described for the embodiments above, an increase in this distance, in turn, increases the torque applied to lid 422 rotate lid 422 relative to container 12. More specifically, as shown in FIG. 17 with additional reference to FIG. 15, a distance $D_5$ is defined between an outside surface of lid 422 and a center axis 450 of lid 422 about container 12. Distance $D_5$ is the distance at which force would be applied to a typical lid (not shown) not making use of the present innovation but sized similarly to lid 422. When lever 424 is rotated into a use position, lever 422 contacts first sidewall portion 468 to stop additional rotation of lever 424 relative to lid 422, the force applied to an outside of lever 424 is positioned a distance $D_6$ from center axis 450 of lid 422. The increase between distance $D_5$ and distance $D_6$ proportionally increases the effect of the applied force, such that a lesser force applied at $D_6$ is needed to initiate rotation of lid 422 about container 12 than a force applied at $D_5$. In this manner, when a force is applied to outer regions of lever 424, as generally indicated via the arrow in FIG. 17, that force is amplified, such that lid 422 is more easily removed from container 12, than when a similar force is applied directly to an exterior of lid 422. In one example, distance $D_6$ is at least about 1.5 times distance $D_5$, and, in one example, at least about 2 times distance $D_6$, such that the force applied to lever 424, in the use position, is amplified by at least about 1.5, and, in one example, at least about 2 times, a similar force applied directly to lid 422. Otherwise stated, lever 424 serves to amplify the effect of applied force resulting in a larger amount of torque being applied to lid 422 per the amount of force applied to lever 424.

Lever 424 is easily rotated back into a storage position from the use position for storage within the footprint of lid 422. As such, a compact closure 414 is provided having a built in lever 424 rotatable to aid a user in more easily opening and closing a corresponding container via rotation of closure 414 relative to container 12.

In one example, closure 414 is formed with additional features, such as one or more pressure equalization feature, that are of particular interest upon the initial opening of an associated container that may be factory or otherwise sealed in an airtight manner as shown in FIGS. 15-24. In the illustrated and other related examples, the additional features of closure 414 permit a user to achieve pressure equalization of an initial vacuum sealed, or otherwise airtight, container cavity covered by closure 414 and means for amplifying opening torque applied to closure 414 in one single movement of lever 424 from a storage to a use position. The pressure equalization features of closure 414 are especially of importance with food or other ingestible products that may be preheated prior to sealing. More specifically, as generally illustrated in FIGS. 15-17 and more particularly illustrated in the detail view of FIG. 18, in one example, primary panel 440 of lid 422 additionally includes a recess 512 with a frangible protrusion 514, which is one example of a pressure equalization feature, plugging the recess and extending upwardly therefrom beyond top surface 484 of primary panel 440. When frangible protrusion 514 is in place, the airtight or vacuum seal between closure 414 and a corresponding container is maintained. However, frangible protrusion 514 is configured to be broken off of primary panel 440 when a horizontal force is applied thereto in a manner creating an open port, as generally indicated at 530, to an interior of the container and allowing air into the corresponding container.

Figure 20:
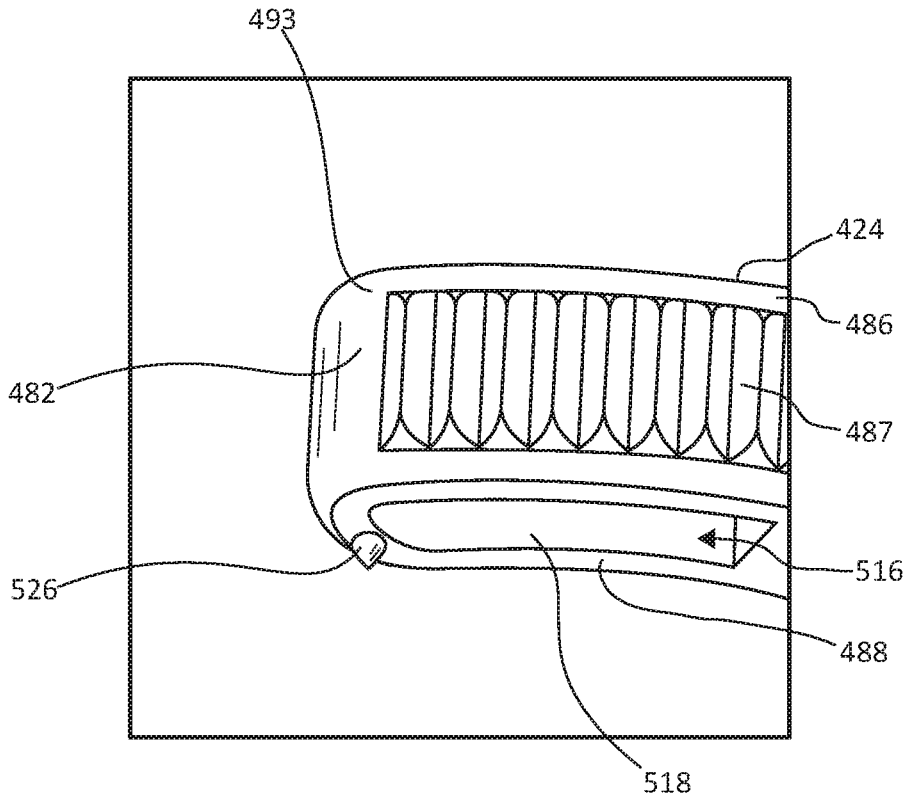
FIG. 20 is a detailed, bottom perspective view illustration of the lever of FIG. 15, according to one embodiment of the present invention.

In this example, lever 424 is formed such that a cavity 516 is defined between opposing portions of sidewall 482 as illustrated with reference to FIG. 20, with interior surfaces 518 of sidewall 482 being immediately adjacent cavity 516. When lever 424 is in the storage position (FIG. 14), frangible protrusion 514 extends upwardly beyond primary panel 440 into cavity 516 of lever 424. Rotation of lever 424 about coupling pin 426 toward a use position (FIG. 15), moves lever 424 in a manner pushing interior surface 518 of lever 424 into contact with frangible protrusion 514. Continued movement of lever 424 toward use position breaks frangible protrusion 514 away from a remainder of primary panel 440 leaving a small opening to a container cavity (not shown) in recess 512, thus breaking any air tight seal between lid 422 and the associated container.

In another example, frangible protrusion 514 is not frangible and/or may have a ramped surface (not shown) such that protrusion 514 serves as snap stop or lock for lever 424. More specifically, such a protrusion 514 would assist in holding lever in a storage position via interaction with interior surface 518 of lever 424 while still being fairly easily cleared and moved over by lever 424 when a slight forces is applied thereto.

Figure 18:
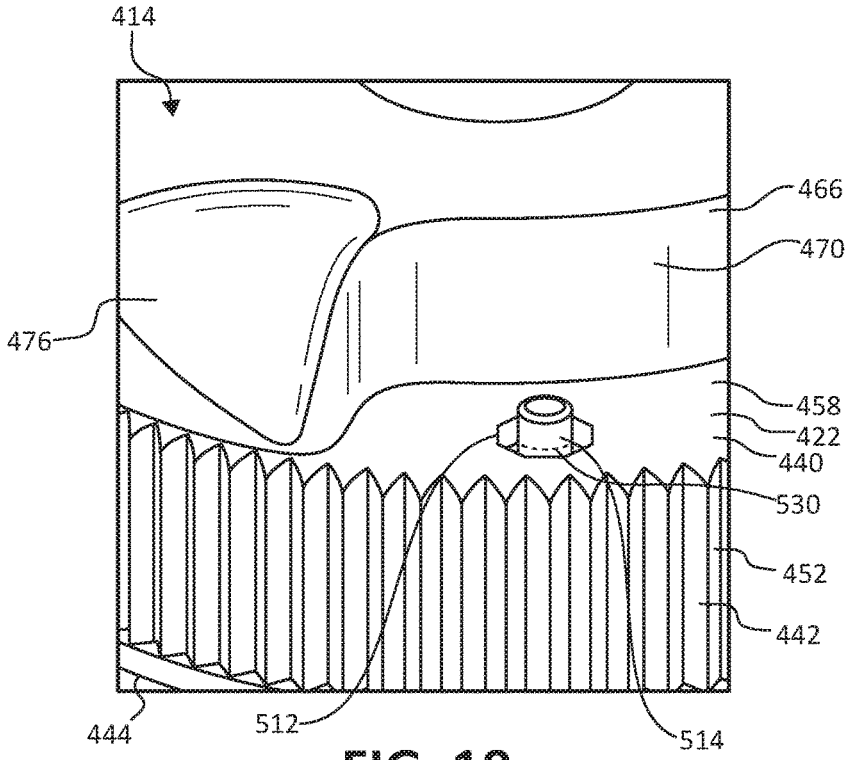
FIG. 18 is detailed perspective view illustration of a portion of a lid of the closure of FIG. 14, according to one embodiment of the present invention.
Figure 19:
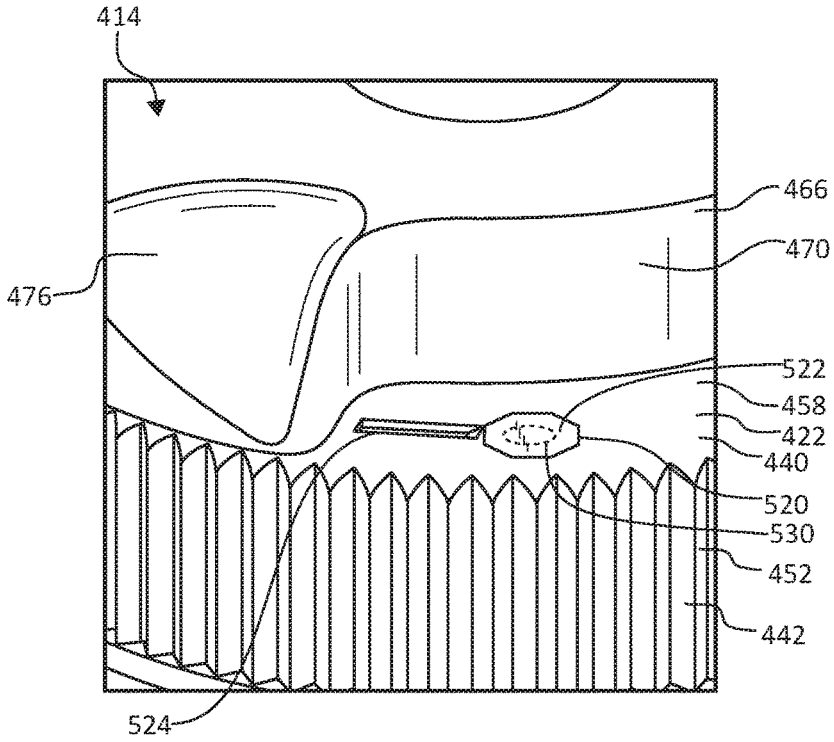
FIG. 19 is a detailed perspective view illustration of a portion of an alternative portion of a lid of the closure of FIG. 14, according to one embodiment of the present invention.

FIG. 19 illustrates an airtight seal feature as an alternative to frangible protrusion 514 of FIG. 18. In the embodiment of FIG. 19, an aperture 520 is formed through primary panel 440 and a thin diaphragm 522, which is one example of a pressure equalization feature, or similar material extends over aperture 520 in a manner providing an airtight seal thereto. In this embodiment, lever 424 additionally includes a protruding member 526 extending further downwardly from bottom edge 488 of lever 424. When lever 424 is in a storage position, protruding member 526 is spaced from diaphragm 522, for example is located in an angled groove 524 along primary panel 440 leading to diaphragm 522. Rotation of lever 424 about coupling pin 426 toward a use position, moves protruding member 526 over diaphragm 522 puncturing diaphragm 522 leaving a small opening or open port, generally indicated at 530 to a container cavity (not shown) in within aperture 520, thereby breaking any air tight or vacuum seal between lid 422 and the associated container to allow an equalization of pressure between an interior and an exterior of an interior compartment of the associated container. Other airtight seal formations are also contemplated, as is elimination of any airtight seal feature.

Figure 21:
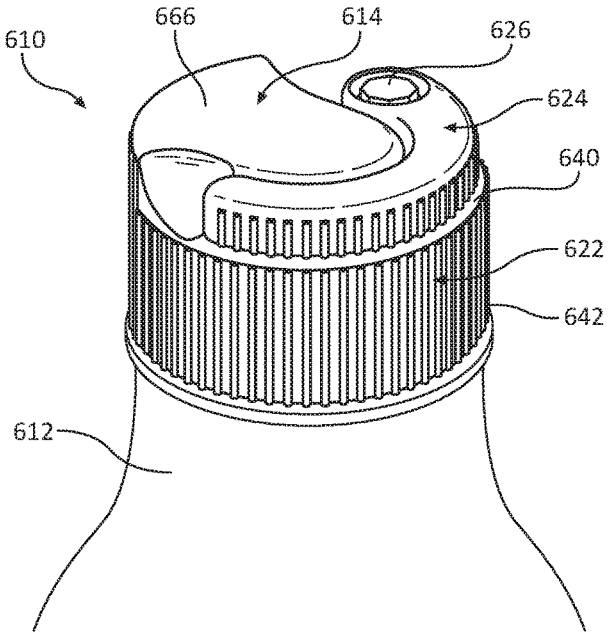
FIG. 21 is a front perspective view illustration of a container assembly having a lever in a storage position, according to one embodiment of the present invention.
Figure 22:
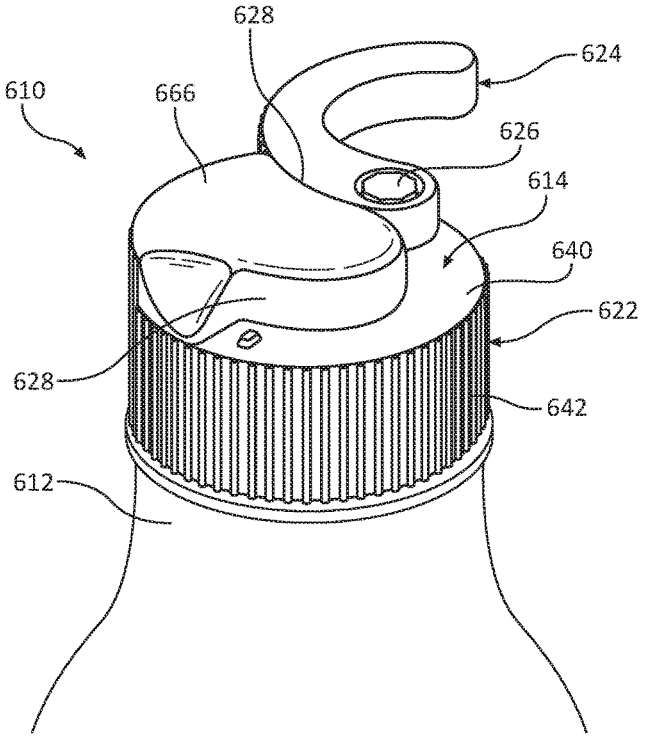
FIG. 22 is a front perspective view illustration the container assembly of FIG. 21 where the lever is in a use position, according to one embodiment of the present invention.

FIGS. 21 and 22 illustrate an embodiment of a container assembly 610, according to one embodiment of the present invention. Container assembly 610 includes any suitable container, such as bottle 612 partially illustrated in FIGS. 21 and 22, and a closure 614. Closure 614 is substantially similar to closure 414 other than being resized to fit a neck of bottle 612 rather than the wider mouth closures described above. Closure 614 includes a lid 622 and a lever 624. Lid 622 includes a primary panel 640, skirt 642, coupling pin 626, protruding block 666, and other features substantially identical to lid 422 with primary panel 540, sidewall 542, coupling pin 426, and protruding block 566, etc. other than dimensional changes. Likewise, lever 624 is substantially identical to lever 524 other than dimensional attributes. Lever 624 couples with lid 622 in a manner leaving lever 624 rotatable about coupling pin 626 as limited only by protruding block 666 just as lever 524 couples with lid 422 in a manner leaving lever 524 rotatable about coupling pin 426 limited by protruding block 466. In this manner, closure 614 provides similar advantages and force amplification during opening of container 612 as closure 414 provides.

However, since the overall diameter and turning radius of closure 614 about container 612 is quite small in nature, in some instances the simple amplification of forces via lever 624 may not be sufficient to remove closure 614 from container 612 in some instances, such as where the user is particularly weak. In these instances, a cylindrical or otherwise suitably shaped tool 700 is used to further assist in forcibly opening container 612. In such an embodiment, an exterior surface 702 of tool 700 is sized to partially nest with the interior curvature of lever 624, and extends above and below lever 624. As such, tool 700 provides additional surface area for a user to grasp and/or otherwise interface to increase the force the user is able to impart to lever 624 as will be apparent to those of skill in the art reading this application. While tool 700 is shown with closure 614, in one example a similar tool may be utilized with other closures described herein, including, but not limited to closure 414 illustrated in FIGS. 14-17.

Figure 23:
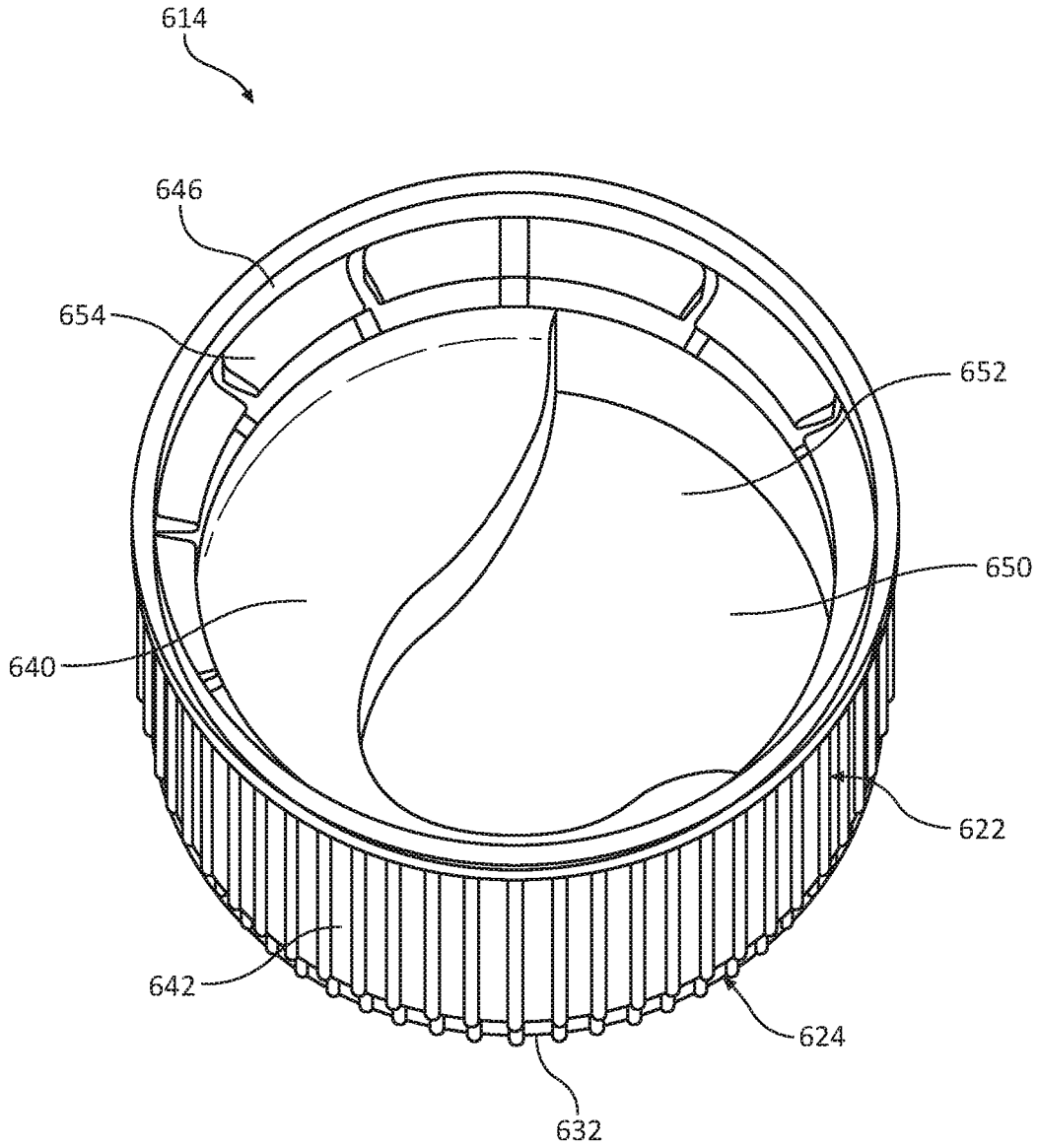
FIG. 23 is a bottom perspective view illustration of a closure of the container assembly of FIG. 21, according to one embodiment of the present invention.
Figure 24:
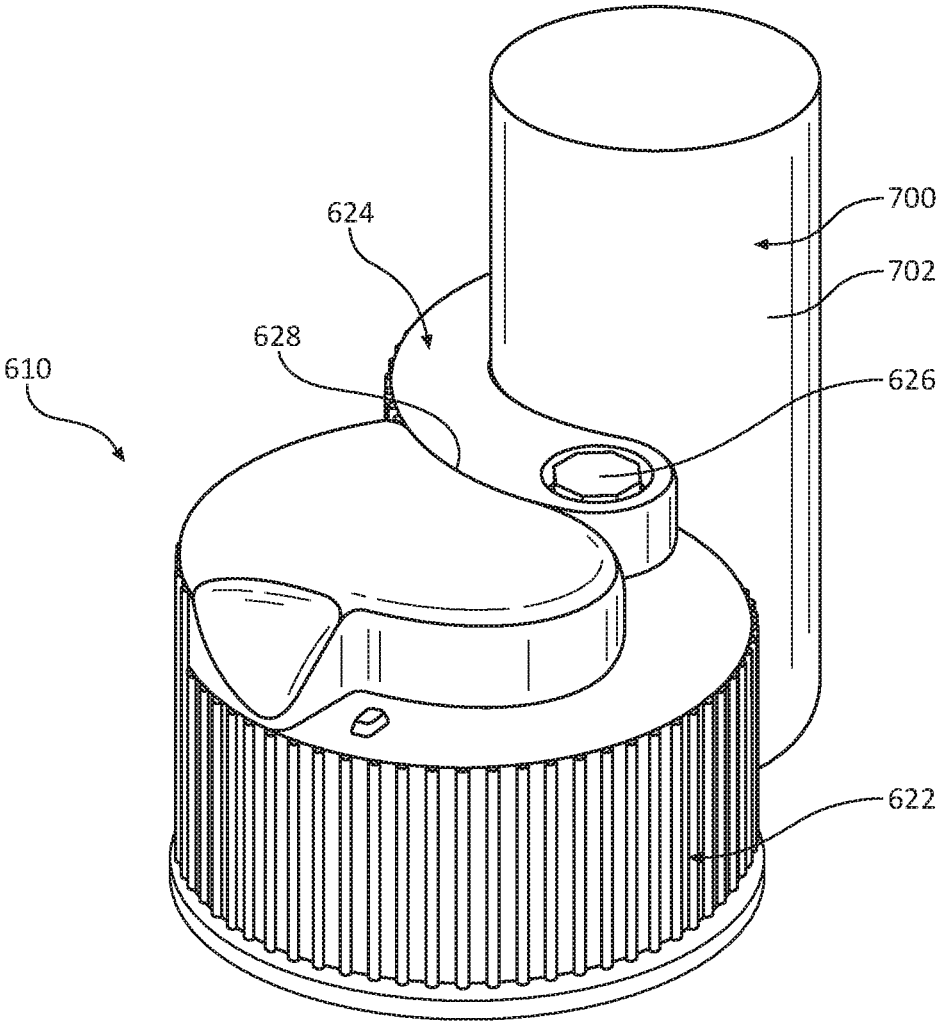
FIG. 24 is a front perspective view illustration of the container assembly of FIG. 21 with a grip amplification tool, according to one embodiment of the present invention.

FIG. 23 illustrates an underside of closure 614 simply to illustrate that in one embodiment a diaphragm or other elastomeric and sealing material 652 may extend over a bottom of primary panel 640, such as over a recess 650 defined under protruding block 666. In yet another example, rather than including an additional sealing material 652, material forming lid 622 is greatly thinned over recess 650 such that the vacuum seal of closure 614 to an associated container would result in a concavity of a top panel of recess 650 when the vacuum seal is maintained, while releasing to a non-concave state when the vacuum is seal is negated. In this manner, both visual and tactile indication of the integrity of the vacuum seal is achieved; with a non-concave top surface of protruding block 666 (see FIGS. 21 and 22) indicating to the user that the vacuum seal has been previously released.

FIG. 23 also illustrates an alternative rotational coupling means 654 extending inwardly from interior surfaces 646 of skirt 642 to threads as described above. In this example, tabs 654 extend inwardly from interior surface 646 in two rows each extending circumferentially around an inner diameter of skirt 642. Such tabs 654 are configured to removably interact with ribs about an opening of an associated container and release the container upon application of a counterclockwise or other rotatable force applied to closure 614. Other various rotatable coupling means are also contemplated and will be apparent to those of skill in the art upon reading this application.

In view of the above, the current innovation provides a closure with an integrated lever useful in opening containers making use of the closure by amplifying opening and/or closing forces applied thereto. More particularly, the lever is rotatable, relative to a container-covering lid of the closure, between a storage position and at least one use position. In the storage position the lever is maintained within the footprint of the lid, such that no additional horizontal shelf or box space is required to support a resultant container assembly. When the lever is rotated to the use position, the lever extends considerably beyond an outer perimeter of the remainder of the closure (e.g., the lid) outside a footprint of the lid. In this manner, the lever provides additional spacing from a rotational center of lid to a location where an opening or closing force is applied to closure, resulting in an amplification of the torque applied to open or close the container per unit force as compared to force applied direction to an edge of the lid.

The closure, as disclosed herein, is simple to manufacture and assemble as it generally consists of two parts, the lid and the lever, which can easily be snapped together and made ready for use. In one example, the above-described features of the closure make the closure ready for use in existing packaging runs. The lever in addition includes substantially planar top surface, in some examples, that may be used in marketing the closure and/or products maintained therein, providing instructions, and/or other information in either a visually or tactilely (e.g., Braille) manner.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A closure for rotatably coupling with a container to cover an opening of the container, the closure comprising:

a lid including:

a primary panel defining a top surface, a skirt extending away from the primary panel and being configured to couple with the container, and a stop positioned adjacent the top surface of the primary panel, wherein the lid defines an outermost perimeter, the primary panel is continuous within the outermost perimeter to fully cover the opening of the container when the lid is coupled to the container, and a footprint of the lid is defined within the outermost perimeter of the lid; and a lever rotably coupled with the lid such that the lever rotates relative to the lid between a use position and a storage position;

wherein:

the lid includes a coupling pin extending upwardly from the primary panel, the lever includes an aperture therethrough, the lever is rotatably coupled to the lid by receiving the coupling pin through the aperture such that the lever rotates about the coupling pin between the use position and the storage position, when the lever is in the storage position, the lever is maintained substantially within the footprint of the lid, and when the lever is in the use position, the lever extends outwardly beyond the outermost perimeter of the lid contacting the stop of the lid such that force applied to lever to remove the lid from the container is transferred to the lid via the stop.

2. The closure of claim 1, wherein the force applied to the lever is applied outside the footprint of the lid in a manner providing a greater torque to the lid relative to the container via the stop than a torque created by an equal force applied directly to the lid to more easily rotate the lid to disengage the container.

3. The closure of claim 2, wherein the greater torque is greater than the torque resulting from the equal force applied directly to the lid by a factor of at least about 1.2.

4. The closure of claim 2, wherein the lever extends away from a center axis of the lid a first distance that is at least about 1.2 times greater than a second distance measured from the center axis of the lid to the outermost perimeter of the lid.

5. The closure of claim 1, wherein the lever is positioned adjacent the top surface of the primary panel, the primary panel of the lid defines a substantially planar top surface extending substantially perpendicularly to the skirt, and the lever rotates in a plane substantially parallel to the substantially planar top surface of the lid.

6. The closure of claim 1, wherein the lever is circular in shape.

7. The closure of claim 1, wherein the skirt extends substantially around an outer perimeter of the primary panel.

8. The closure of claim 1, wherein the skirt of the lid includes threads configured to interact with threads of the container to securely couple the lid to the container.

9. The closure of claim 1, wherein:

the stop is a first stop of two stops of the lid, the use position of the lever is an opening use position used in removing the closure from the container, and the lever additionally rotates to a closing use position, contacting a second stop of the two stops of the lid, used in tightening the closure on the container.

10. A closure for rotatably coupling with a container to cover an opening of the container, the closure comprising:

a lid including:

a primary panel defining a top surface, a primary panel defining a top surface, a groove depending from the primary panel and being curvilinear in shape centered about a rotational axis of the lever about the lid, a skirt extending away from the primary panel and being configured to couple with the container, and two stops including a first stop positioned adjacent the top surface of the primary panel and a second stop, wherein the lid defines an outermost perimeter, the primary panel is continuous within the outermost perimeter to fully cover the opening of the container when the lid is coupled to the container, and a footprint of the lid is defined within the outermost perimeter of the lid; and a lever rotably coupled with the lid such that the lever rotates relative to the lid between a use position and a storage position, the lever including a bottom depending peg extending below a remainder of the lever and received within the groove;

wherein:

the first stop is defined by a first end of the groove such that moving the lever from the storage position to the opening use position moves the peg within groove until the peg contacts the first stop, the second stop is defined by a second end of the groove, opposite the first end of the groove, such that moving the lever from the storage position to the closing use position, moves the peg within groove until the peg contacts the second stop, the use position of the lever is an opening use position used in removing the closure from the container, the lever additionally rotates to a closing use position, contacting the second stop of the lid, used in tightening the closure on the container when the lever is in the storage position, the lever is maintained substantially within the footprint of the lid, and when the lever is in the opening use position, the lever extends outwardly beyond the outermost perimeter of the lid contacting the first stop of the lid such that force applied to lever to remove the lid from the container is transferred to the lid via the first stop.

11. A closure for rotatably coupling with a container to cover an opening of the container, the closure comprising:

a lid including:

a primary panel defining a top surface, a skirt extending away from the primary panel and being configured to couple with the container, and a stop positioned adjacent the top surface of the primary panel, wherein the lid defines an outermost perimeter, the primary panel is continuous within the outermost perimeter to fully cover the opening of the container when the lid is coupled to the container, and a footprint of the lid is defined within the outermost perimeter of the lid; and a lever rotably coupled with the lid such that the lever rotates relative to the lid between a use position and a storage position;

wherein:

when the lever is in the storage position, the lever is maintained substantially within the footprint of the lid, and when the lever is in the use position, the lever extends outwardly beyond the outermost perimeter of the lid contacting the stop of the lid such that force applied to lever to remove the lid from the container is transferred to the lid via the stop, the primary panel defines a groove depending from the primary panel and being curvilinear in shape centered about a rotational axis of the lever about the lid, the groove is entirely spaced from the outermost perimeter of the lid, the lever includes a bottom depending peg extending below a remainder of the lever and received within the groove, and the stop is defined by an end of the groove such that moving the lever from the storage position to the use position, moves the peg within groove until peg contacts the stop.

12. The closure of claim 11, wherein the lever defines a lever outermost perimeter substantially identical in size and shape to the outermost perimeter of the lid.

13. A closure for rotatably coupling with a container to cover an opening of the container, the closure comprising:

a lid including:

a primary panel defining a top surface, a skirt extending away from the primary panel and being configured to couple with the container, and a stop positioned adjacent the top surface of the primary panel, wherein:

the lid defines an outermost perimeter, the primary panel is continuous within the outermost perimeter to fully cover the opening of the container when the lid is coupled to the container, and a footprint of the lid is defined within the outermost perimeter of the lid, a protruding block extends upwardly from the top surface of the primary panel and defines a first surface and a second surface, and the first surface and the second surface intersect one another at a point of the protruding block nearest a center of the lid and extend away from each other toward the outer perimeter of the lid to form the protruding block in with a wedge shape; and a lever rotably coupled with the lid such that the lever rotates relative to the lid between a use position and a storage position;

wherein:

the first surface is the stop of the lid, such that in the use position, the lever abuts the first surface of the protruding block, when the lever is in the storage position, the lever is maintained substantially within the footprint of the lid, and when the lever is in the use position, the lever extends outwardly beyond the outermost perimeter of the lid contacting the stop of the lid such that force applied to lever to remove the lid from the container is transferred to the lid via the stop.

14. The closure of claim 13, wherein:

the stop is a first stop, the use position is an opening use position configured to be used to transfer force from the lever to the lid when removing the closure from the container, the second surface of the protruding block defines a second stop, the lever additionally rotates to a closing use position contacting the second stop such that the lever extends beyond an outer perimeter of the lid in each of the opening use position and the closing use position, and the closing use position configured to be used to transfer force applied to the lever outside the outermost perimeter of the lid when tightening the closure on the container.

15. The closure of claim 14, wherein the first surface and the second surface are concave, curved surfaces each having a block curvature complementing a lever curvature of a corresponding portion of the outermost perimeter of the lever that selectively contacts each of the first surface and the second surface such that a substantial entirety of a length of each of the first surface and the second surface contact the corresponding portions of the outermost perimeter of the lever in the opening use position and the closing use position, respectively.

16. The closure of claim 1, wherein the lid includes a pressure equalization feature coupled to the primary panel, the pressure equalization feature is positioned adjacent the lever in the storage position, such that rotation of the lever to the use position moves the lever to impact the pressure equalization feature in a manner creating an open port to an interior of the container, which, in turn, results in an equalization of pressure between the interior of the container and an environment surrounding the container.

17. The closure of claim 16, wherein the pressure equalization feature is one of a frangible protrusion that is broken off of a remainder of the lid when impacted and a puncturable diaphragm.

18. A container assembly comprising:

a container defining a storage chamber and an open top;

a closure for rotatably coupling with the container to cover the open top of the container, the closure comprising:

a lid including:

a primary panel defining a top surface, a skirt extending away from the primary panel and being configured to couple with the container, and a first stop positioned adjacent the top surface of the primary panel, a second stop positioned adjacent the top surface of the primary panel, wherein the lid defines an outside perimeter, and a footprint of the lid is defined within the outermost perimeter of the lid, and a lever rotably coupled with the lid such that the lever rotates relative to the lid between an opening use position and a storage position;

wherein:

the lid includes a coupling pin extending upwardly from the primary panel, the lever includes an aperture therethrough, the lever is rotatably coupled to the lid by receiving the coupling pin through the aperture such that the lever rotates about the coupling pin between the use position and the storage position, when the lever is in the storage position, the lever is maintained substantially within the footprint of the lid, when the lever is in the opening use position, the lever extends outwardly beyond the outermost perimeter of the lid contacting the stop of the lid such that an opening force applied to lever outside the footprint of the lid is transferred to the lid via the stop, facilitating removal of the closure from around the open top of the container, and the lever additionally rotates in a direction opposite the opening use position to a closing use position contacting the second stop such that the lever extends beyond the footprint of the lid and the closure is tightly secured to the container via a closing force applied to the lever outside the footprint of the lid, such that the closure provides for bi-directional amplification of the closing force via the lever, the first stop, and the second stop relative to a force applied to an outer perimeter of the lid.

19. The container assembly of claim 18, wherein:

the lever extends away from a center axis of the lid a first distance that is at least about 1.2 times greater than a second distance measured from the center axis of the lid to the outermost perimeter of the lid, such that application of a first force to the lever imparts a greater torque to the lid relative to the container than a torque imparted to the lid relative to the container due to application of a second force applied directly to the lid, and the first force is equal to the second force.

* * * * *